US005774150A

United States Patent [19]

Kobayashi et al.

[11] Patent Number: 5,774,150

[45] Date of Patent: Jun. 30, 1998

[54] METHOD FOR MANUFACTURING INK JET HEAD, INK JET HEAD MANUFACTURED BY SUCH A METHOD, AND INK JET APPARATUS PROVIDED WITH SUCH A HEAD

[75] Inventors: Junichi Kobayashi, Ayase; Keiichi Murai, Yokohama; Shigeo Toganoh, Tokyo; Toshiaki Sasaki, Abiko; Hajime Yamamoto, Yokohama, all of Japan

[73] Assignee: Canon Kabushiki Kaisha, Tokyo, Japan

[21] Appl. No.: 778,283

[22] Filed: Jan. 3, 1997

Related U.S. Application Data

[63] Continuation of Ser. No. 70,258, Jun. 2, 1993, abandoned.

[30] Foreign Application Priority Data

| | | | |
|---|---|---|---|
| Jun. 4, 1992 | [JP] | Japan | 4-144503 |
| Jun. 29, 1992 | [JP] | Japan | 4-171193 |
| Jun. 29, 1992 | [JP] | Japan | 4-171194 |
| Jun. 29, 1992 | [JP] | Japan | 4-171195 |
| Jun. 29, 1992 | [JP] | Japan | 4-171196 |
| Jun. 29, 1992 | [JP] | Japan | 4-171197 |

[51] Int. Cl.[6] ..... B41J 2/05

[52] U.S. Cl. ..... 347/63

[58] Field of Search ..... 347/18, 56, 63

[56] References Cited

U.S. PATENT DOCUMENTS

| | | | |
|---|---|---|---|
| 4,243,994 | 1/1981 | Kobayashi et al. | 347/56 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,723,129 | 2/1988 | Endo et al. | 347/56 |
| 4,740,796 | 4/1988 | Endo et al. | 347/56 |
| 4,775,445 | 10/1988 | Noguchi | 156/637 |
| 4,831,390 | 5/1989 | Deshpande et al. | 347/18 |
| 4,878,992 | 11/1989 | Campanelli | 156/633 |
| 5,030,317 | 7/1991 | Noguchi | 156/630 |

FOREIGN PATENT DOCUMENTS

| | | | |
|---|---|---|---|
| 0469916 | 8/1991 | European Pat. Off. . | |
| 0469916 | 2/1992 | European Pat. Off. . | |
| 59-123670 | 7/1984 | Japan . | |
| 59-138461 | 8/1984 | Japan . | |
| 231761 | 10/1987 | Japan | 347/63 |
| 62-253457 | 11/1987 | Japan . | |
| 306251 | 12/1989 | Japan | 347/63 |

*Primary Examiner*—N. Le
*Assistant Examiner*—L. Anderson
*Attorney, Agent, or Firm*—Fitzpatrick, Cella, Harper & Scinto

[57] ABSTRACT

A method for manufacturing an ink jet head comprises a process to prepare a substrate where ink discharging energy generating elements are arranged; a process to provide a solid layer on the aforesaid substrate for the formation of liquid passages corresponding to the foregoing energy generating elements and at the same time, to provide a solid layer for the formation of a liquid chamber; a process to cover the substrate having the aforesaid solid layers with a resin; and a process to remove the aforesaid solid layers. The thickness of the aforesaid resin layer covering the upper part of at least a portion of the aforesaid solid layer for the formation of the ink passages on the side which is different from the side where the solid layer for the formation of a liquid chamber exists is made thinner than the thickness of the aforesaid resin layer covering the upper part of the solid layer for the formation of the liquid chamber, hence providing a highly reliable ink jet head having an excellent property suitable for cutting process required for obtaining the discharging port portion precisely and accurately as well as a secure adhesion between the resin and the substrate.

7 Claims, 13 Drawing Sheets

METHOD FOR MANUFACTURING INK JET HEAD, INK JET HEAD MANUFACTURED BY SUCH A METHOD, AND INK JET APPARATUS PROVIDED WITH SUCH A HEAD

This application is a continuation, of application Ser. No. 08/070,258, filed Jun. 2, 1993, now abandoned.

BACKGROUND OF THE INVENTION

1. Field of the Invention

The present invention relates to an ink jet head for generating ink droplets used for the ink Jet recording method, a method for manufacturing thereof, and an ink jet apparatus provided with an ink jet recording head.

2. Related Background Art

For an ink jet recording head applicable to the ink jet recording method (hereinafter referred to as recording head), there are generally provided discharging ports for discharging ink, an ink liquid chamber for storing the ink which will be supplied to the foregoing discharging ports, the liquid passages which conductively connect the foregoing discharging ports and liquid chamber, the energy generating elements which are arranged in part of the foregoing liquid passages to generate energy for discharging ink, and a supply inlet for supplying ink from the outside to the foregoing liquid chamber.

As the method for manufacturing a recording head such as this, there has hitherto been known the following:

(1) A method wherein a first substrate having energy generating elements is provided, and discharging ports, liquid passages, the recesses where liquid passages and a liquid chamber are formed, and a supply inlet for conductively connecting the aforesaid liquid chamber and the outside are provided by means of processing such as cutting and etching for a second substrate, and then, the aforesaid first and second substrates are positioned and adhesively bonded.

(2) A method wherein a positive or negative photosensitive dry film is bonded to a first substrate made of a glass or the like where energy generating elements are provided; of the aforesaid photosensitive dry film, a pattern corresponding to discharging ports, liquid passages, and a liquid chamber is exposed with or without a mask; a solid layer of the pattern corresponding to the discharging ports, liquid passages, and liquid chamber is developed and provided for the surface of the first substrate; after that, a liquid setting material mixed with a setting agent is coated on the aforesaid solid layer and the first substrate in an appropriate thickness, and left intact for a long time at a given temperature in order to harden the aforesaid setting material; then, after the first substrate where the aforesaid setting material is hardened is cut in a position in which the discharging ports are formed so that the end of the aforesaid solid layer is exposed, the aforesaid solid layer is immersed into a solvent to dissolve the aforesaid solid layer; thus dissolving the aforesaid solid layer to remove it from the first substrate where the aforesaid setting material is hardened in order to provide a space therein for the liquid passages and the liquid chamber.

(3) A method (disclosed in Japanese Patent Application Laid-Open No. 62-253457) wherein a positive or negative photosensitive dry film is adhesively bonded to a first substrate where energy generating elements are provided, and of the aforesaid photosensitive dry film, a pattern corresponding to discharging ports, liquid passages, a liquid chamber is exposed with or without a mask, and a solid layer of the aforesaid pattern corresponding to the discharging ports, liquid passages, and liquid chamber is developed and provided on the first substrate; an active energy radiation setting material which is hardened by the active energy rays is coated on the aforesaid solid layer and the first substrate in an appropriate thickness; and a second substrate having an active energy radiation penetrability, which is provided with a recess for forming a part of the liquid chamber and a supply inlet, is bonded on the aforesaid active energy radiation setting material so that the aforesaid recess is matched with the position where the formation of the liquid chamber is anticipated in order to produce a laminated member; then, the second substrate is masked to cover the portion of the aforesaid active energy radiation setting material where the liquid chamber is anticipated to be formed, and the active energy rays are irradiated to the active energy radiation setting material through the second substrate in order to harden the material; subsequently, the laminated member where the aforesaid active energy radiation setting material is hardened is cut in the position where the discharging ports are formed so that the end of the aforesaid solid layer is exposed; and then, the aforesaid solid layer and the active energy radiation setting material which is not hardened yet are immersed in a solvent to dissolve and remove the aforesaid solid layer and the active energy radiation setting member from the aforesaid laminated member in order to form a space therein for the liquid passages and the liquid chamber. See U.S. Pat. No. 5,030,317.

(4) A method wherein a portion corresponding to discharging ports, liquid passages, and a liquid chamber is formed by a solid layer made of a removable material on a first substrate made of a glass or the like on which ink discharging energy generating elements are provided; of the surface of the aforesaid solid layer, the surface portion other than a portion corresponding at least to a part of the ink liquid chamber is covered with a mold resin by the application of a transfer mold formation on the aforesaid solid layer and the first substrate; then, after the first substrate is cut in a position where the discharging ports are formed to allow the end of the aforesaid solid layer to be exposed, the aforesaid solid layer is immersed in a solvent to dissolve it, thus dissolving and removing the aforesaid solid layer from the first substrate covered with the mold resin in order to provide a space therein for forming the liquid passages and the liquid chamber. See EP 0469916A1.

In the above-mentioned each of the conventional methods for manufacturing a recording head, there are problems yet to be solved as follows:

In the method for manufacturing a recording head described in the paragraph (1), although there is an advantage that it is possible to manufacture a recording head having a large liquid chamber suitable for a high speed recording by making the recess formed in the second substrate large, the minute energy generating elements on the first substrate and the minute liquid passages on the second substrate must be positioned precisely when the first and second substrates are adhesively bonded, and also, a special measure must be taken so as not to allow any adhesives to flow into the minute liquid passages when these substrates are bonded. Because of these, the apparatus becomes complicated and expensive. Also, this leads to the lowered productivity in its mass production; hence increasing the cost of the product. This is the problem yet to be solved.

In the method for manufacturing a recording head described in the paragraph (2), there is an advantage that the problem encountered in the method described in the paragraph (1) when the first and second substrates are adhesively bonded can be solved, but it is impossible to make the volume of the liquid chamber provided for the first substrate sufficiently large because such volume is limited to a height which is equal to the thickness of the pattern-like solid layer provided on the first substrate. Also, the manufacturing process is complicated, requiring more time and more numbers of processes. Therefore, it is equally lacking the productivity in its mass production; hence increasing the cost of the product. This is again the problem yet to be solved.

The method for manufacturing a recording head described in the paragraph (3), there is an advantage that a recording head having a large liquid chamber can be manufactured by making the recess for forming the other part of the liquid chamber provided in the second substrate large, and that it is possible to solve the problem encountered when the first and second substrates are adhesively bonded in the method for manufacturing a recording head described in the paragraph (1). However, as in the method described in the paragraph (2), the manufacturing process is complicated, requiring more time, and still more numbers of processes. This method equally lacks the productivity in its mass production, leading to the cost up of the product. This is the problem yet to be solved.

The method for manufacturing a recording head described in the paragraph (4) enables the above-mentioned problems encountered in the methods (1), (2), and (3) to be solved and provide an inexpensive ink jet recording head which can be mass produced in an excellent productivity. Nevertheless, in consideration of the following aspect, there are still problems to be solved:

(a) When the portion where the discharging ports are formed is cut subsequent to the transfer mold formation, it is necessary to cut the first substrate and the mold resin covering the aforesaid substrate, which are made of different materials. Here, a problem is encountered in cutting them with a desirable precision as well as a desirable plane precision for the discharging port surface. When the discharging ports have a higher density and the substrate size is larger, the thickness of the mold resin should be greater. The thicker the mold resin is, the more conspicuous the stress is exerted in the mold resin.

(b) When the transfer formation is executed after the solid layer is provided on the substrate, the transfer formation die abuts upon the portion of the substrate where no solid layer is formed and scratches it or there is a possibility that the electrical junction is damaged due to the burr or flash of the mold resin.

In order to avoid this, a more precise metallic die must be used at the sacrifice of the cost, which will lead to the cost up of the product eventually.

(c) In order to enhance the adhesion between the substrate and the mold resin, if the reverse side of the substrate is embraced by the mold resin, that is, the so-called package structure is adopted, the heat radiation from the substrate to the outside becomes rather insufficient, and particularly when the number of the thermal energy generating elements is increasingly more for ink discharging, the accumulated heat becomes greater so that an adverse effect may be produced on the resultant image quality or the like.

SUMMARY OF THE INVENTION

The present invention is designed in consideration of the above-mentioned problems in the prior art. It is an object of the invention to provide a more reliable ink jet recording head having a higher resolution (with the discharging ports assembled in a higher density), a method for manufacturing such a head, and a recording apparatus provided with such a head.

It is another object of the present invention to provide a method for manufacturing an ink jet recording head capable of supplying an ink jet head the liquid passages of which are finely processed accurately with an excellent precision and yield.

It is still another object of the present invention to provide a new method for manufacturing an ink jet recording head wherein, of a mold resin which covers a substrate, the thickness of the mold resin at least on the discharging ports and liquid passages is made thinner than on the other part without any additional process in order to improve the yield in the cutting process, and also, the performance of an ink jet recording head is stabilized so that a reliable ink jet recording head can be supplied, and a recording apparatus provided with such a head.

It is a further object of the present invention to provide an inexpensive ink jet recording head which is more precise, more reliable, and adaptable for a mass production with simple processes in a smaller number without the process for adhesively bonding the two substrates after the precise positioning which is required in the prior art, presenting the problems taken in consideration when the present invention is designed, and an ink jet recording apparatus provided with such an ink jet recording head as well as a method for manufacturing such an ink jet recording head.

It is still a further object of the present invention to provide a method for an ink jet recording head capable of supplying an ink jet recording head having highly reliable electrical connections, and an recording apparatus provided with such a head.

It is another object of the present invention to provide a manufacture method whereby to supply an ink jet recording head capable of obtaining a stable discharging with an improved heat radiation while achieving a closer adhesion between the substrate and mold resin, and a recording apparatus provided with such a head.

It is still another object of the present invention to provide an inexpensive ink jet recording head having stable ink discharging characteristics, which is more precise, more reliable, and adaptable for a mass production by forming a large liquid chamber by simple processes in a smaller number without any process required to precisely position the two substrates for adhesive bonding.

In order to achieve these objects, a method for manufacturing an ink jet head according to the present invention comprises the steps of:

preparing a substrate where ink discharging energy generating elements are arranged;

providing a solid layer on the aforesaid substrate for the formation of liquid passages corresponding to the foregoing energy generating elements and at the same time, to provide a solid layer for the formation of a liquid chamber;

covering the substrate having the aforesaid solid layers with a resin; and removing the aforesaid solid layers, wherein the thickness of the aforesaid resin layer covering the upper part of at least a portion of the aforesaid solid layer for the formation of the ink passages on the side different from the side where the solid layer for the formation of a liquid chamber exists is made thinner than the thickness of the aforesaid resin layer covering the upper part of the solid layer for the formation of the liquid chamber, or a method for manufacturing an ink jet head comprising the steps of:

preparing a substrate having ink discharging energy generating elements, and wiring electrodes having the terminal portion electrically connected to the aforesaid elements for the electrical connection with the outside of the substrate;

providing a solid layer for the formation of liquid passages corresponding to the aforesaid energy generating elements on the aforesaid energy;

covering the substrate having the aforesaid solid layer with a resin;

removing the aforesaid solid layer; and providing a solid layer for the protection of the aforesaid terminal portion separately from the aforesaid solid layer for the formation of the liquid passages, or a method for manufacturing an ink jet head comprises the steps of:

preparing a substrate where ink discharging energy generating elements are arranged;

providing a solid layer for the formation of liquid passages on the aforesaid substrate corresponding to the foregoing energy generating elements;

covering the substrate having a solid layer for the formation of liquid passages with an upper die and a lower die, and cover the substrate having said solid layer covered by the aforesaid both dies with a resin;

removing the aforesaid solid layer; and providing on the aforesaid substrate a solid layer for preventing the substrate and the aforesaid dies to abut each other in a position apart from the aforesaid solid layer for the formation of liquid passages, or a method for manufacturing an ink jet head comprises the steps of:

preparing a substrate where ink discharging energy generating elements are arranged;

providing a solid layer for the formation of liquid passages on the aforesaid substrate corresponding to the foregoing energy generating elements;

covering the substrate having the aforesaid solid layer with a resin;

removing the aforesaid solid layer, wherein the aforesaid process to cover the substrate with the resin is a process for covering the reverse side of the substrate simultaneously, but a part of the reverse side of the substrate is exposed, or a method for manufacturing an ink jet head comprises the steps of:

preparing a substrate where ink discharging energy generating elements are arranged;

providing a solid layer for the formation of liquid passages on the aforesaid substrate corresponding to the foregoing energy generating elements;

covering the substrate having the aforesaid solid layer with a resin;

removing the aforesaid solid layer; and arranging a supporting member having a better heat conductance than the aforesaid resin so that it is in contact with the reverse side of the aforesaid substrate, and to cover it with the aforesaid resin together with the aforesaid substrate, or a method for manufacturing an ink jet head, comprising the steps of:

preparing a substrate where ink discharging energy generating elements are provided;

providing a solid layer for the formation of liquid passages corresponding to the aforesaid energy generating elements and at the same time, to provide a solid layer for the formation of a liquid chamber;

covering the aforesaid substrate having the layers with a resin; and removing the aforesaid solid layers, wherein the thickness of the solid layer for the formation of the liquid chamber is greater than that of the solid layer for the formation of the liquid passages.

Also, in order to achieve the above-mentioned objects, there is provided according to the present invention an ink jet head manufactured by each of the foregoing methods of manufacture.

Also, an ink jet apparatus having such an ink jet head and a member mounting the head is provided for the purpose.

BRIEF DESCRIPTION OF THE DRAWINGS

FIG. 3A is a cross-sectional view, and FIG. 3B is a perspective view.

FIG. 7A is a schematic perspective view. FIG. 7B is a schematic cross-sectional view.

FIG. 9A is a schematic cross-sectional view. FIG. 9B is a schematic perspective view.

FIG. 14A is a cross-sectional view. FIG. 14B is a perspective view observed from the hollow hole side.

DETAILED DESCRIPTION OF THE PREFERRED EMBODIMENTS

Hereinafter, with reference to the accompanying drawings, the present invention will be described in detail.

Figure 1:
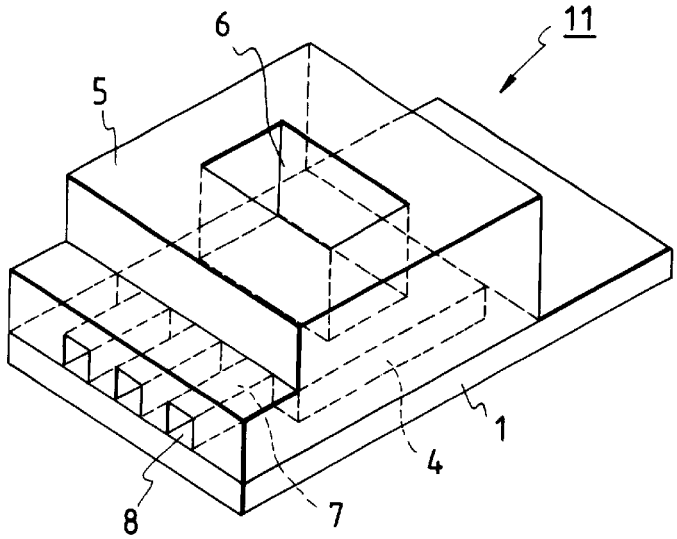
FIG. 1 is a perspective view schematically showing in the best mode of representation an ink jet recording head obtainable by a method according to the present invention.

FIG. 1 is a perspective view schematically showing an example of an ink jet recording head according to a first embodiment of the present invention.

FIG. 2 to FIG. 5 are schematic views illustrating the fundamental mode of a manufacture method according to the first embodiment of the present invention. FIG. 1 to FIG. 5 illustrate the structure of an ink jet recording head according to a manufacture method of the present invention, and an example of the process procedures thereof, respectively. In this respect, while an ink jet recording head having three discharging ports is illustrated, it is of course possible to equally manufacture a high density multi-array ink jet recording head which has its discharging ports in a number more than those illustrated.

Figure 2:
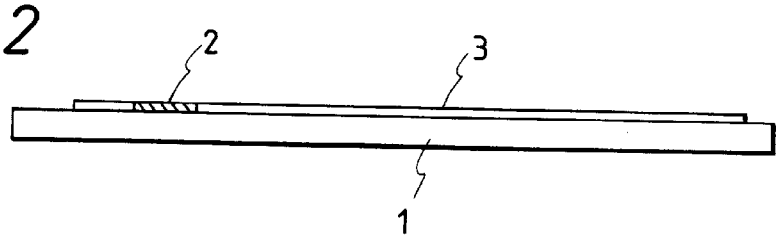
FIG. 2 a cross-sectional view schematically showing a substrate on which discharging energy generating elements and electrodes are arranged according to an embodiment of the present invention.

At first, in the present embodiment, a substrate 1 made of a glass, ceramics, plastic, metal, or the like is used as shown in FIG. 2, for example.

A substrate 1 such as this functions as a part of ink liquid passages, and is usable without any particular restrictions on its configuration, material, and others if only it is functional as a supporting member for a resist which will be described later. On the above-mentioned substrate 1, ink discharging energy generating elements 2 such as electrothermal transducers or piezoelectric elements are arranged in a desired-number. The discharging energy to discharge ink droplets are provided by these ink discharging energy generating elements 2 for ink liquid for recording. Here, for example, if the electrothermal transducers are used as the above-mentioned ink discharging energy generating elements 2, the discharging energy is generated when these elements heat the ink in the vicinity thereof. Also, if the piezoelectric elements are used, for example, the discharging energy is generated by the mechanical vibration of these elements.

In this respect, control signal electrodes 3 are connected to these elements 2 for driving them. Also, in general, for the purpose of improving the durability of part of these discharging energy generating elements and the aforesaid electrodes, there are some cases where a protective film and various other functional layers are provided. There is no problem at all in providing such various functional layers in the present invention, too, as a matter of course.

Figure 3A:
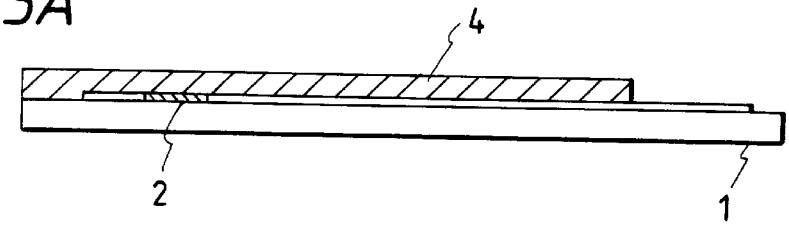
FIGS. 3A and 3B are views showing the formation of a pattern corresponding to ink liquid passages and an ink liquid chamber by a solid layer made of a removable material according to an embodiment of the present invention.
Figure 3B:
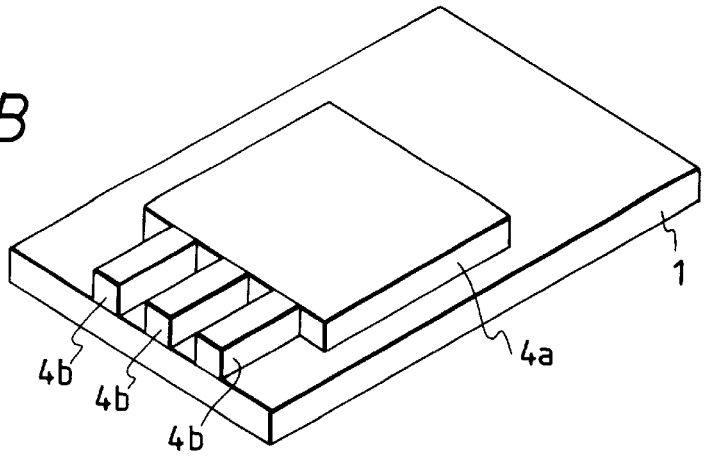

Now, in FIGS. 3A and 3B, on the substrate 1 including the above-mentioned ink discharging energy generating elements 2, there is formed a solid layer 4 made of a resist, for example, which is dissolvable for removal by the application of a solvent or the like. The above-mentioned solid layer 4 comprises a solid layer 4*a* for the formation of an ink chamber and a solid layer 4*b* for the formation of the liquid passages as shown in FIG. 3B. Both the solid layers 4*a* and 4*b* are formed integrally. As a method for forming the solid layer 4, it is possible to employ among others a known method wherein a resist is laminated on the substrate 1, and then, the development is provided subsequent to the irradiation of light through a mask having the pattern for the solid layer. As the resist, those known of a positive or negative type can be utilized. Since the above-mentioned solid layer 4 is dissolved and removed in the latter process as described later, it is not necessarily limited to a resist.

Various kinds of materials can be used if only such a material is removable.

Figure 4:
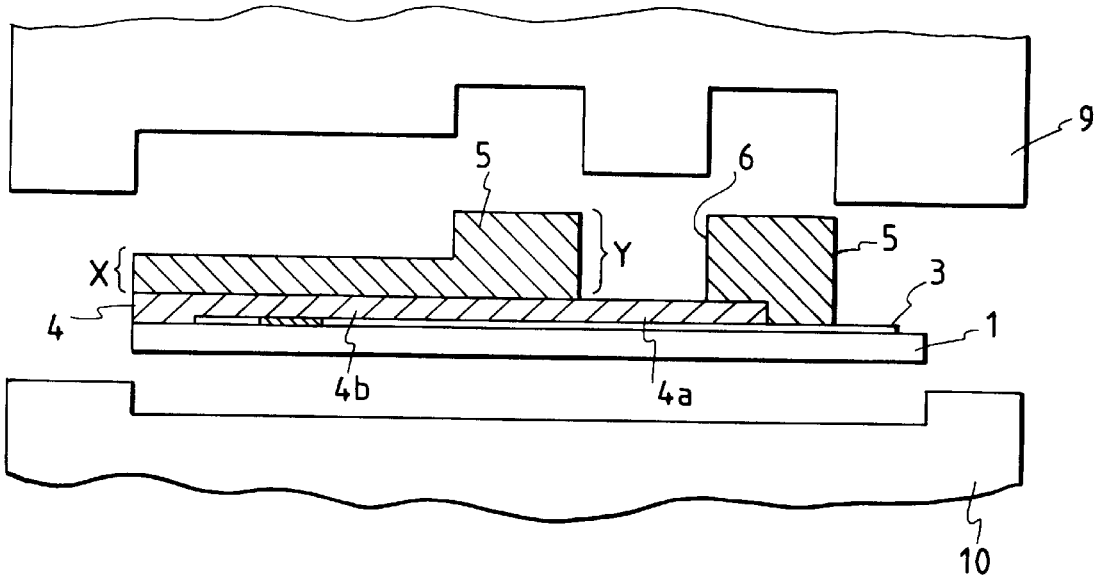
FIG. 4 a cross-sectional view schematically showing the formation of a mold resin by the application of a transfer mold formation according to an embodiment of the present invention.

Then, on the substrate 1 having the solid layer 4 formed as described above, a mold resin layer 5 is formed to cover the solid layer 4 as shown in FIG. 4.

As the formation method, the mold resin layer 5 is formed by the application of a transfer mold formation using a molding upper die 9 and molding lower die 10 capable of forming the contour of an ink jet recording head and an ink supply inlet 6 as shown in FIG. 4.

What is needed here is that the formation dies used for the transfer mold formation apparatus are arranged so that the portions of the formation dies corresponding to the ink discharging ports and ink liquid passages are structured to extrude more than the other portion in order to make the thickness X of the portions of the mold resin corresponding at least to the ink discharging port and ink liquid passages on the discharging port formation side thinner than the thickness Y of the other portion such as the liquid chamber formation part. As described earlier, the reason why the thickness of the resin is made thinner in such portion as above is to enable the later cutting process to be executed desirably only for the formation of the discharging ports. Therefore, the thickness of the portions other than that of the discharging port formation should desirably be as thick as possible from the viewpoint of the structural strength. In this respect, for the foregoing mold resin formation, methods other than the one used for the present embodiment may be used, such as an injection method using a liquid resin, injection formation, potting, and selective exposure method using the resin of an ultra-violet setting type. However, in consideration of the performance suitable for a mass production, precision, and tact, the transfer mold formation method is the best suited for the present invention.

The material for the mold resin layer 5, there can be used an epoxy resin, allyl resin, diallylphthalate resin, silicon resin, polyester, phenol, and melamine. Depending on formation means, the materials which will be set at a normal temperature, or of a type such as heat setting and ultra violet setting among others can be used. For example, acrylic resin, diglycol dialkyl carbonate resin, unsaturated polyester resin, polyurethane resin, polyimide resin, or urea resin can be used among others.

Figure 5:
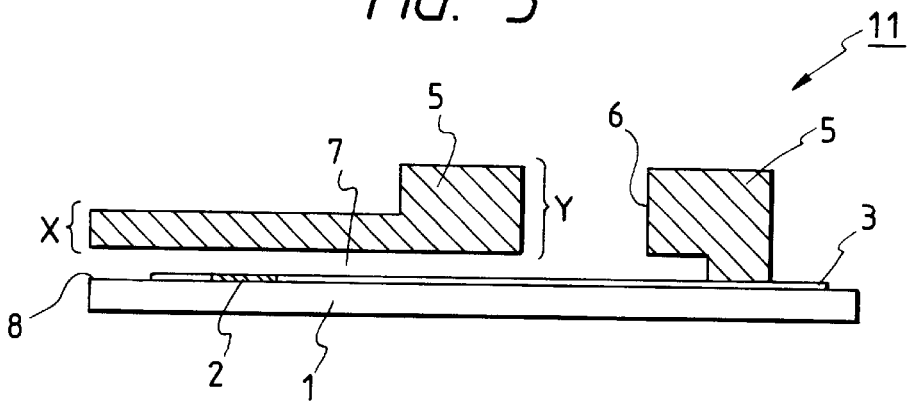
FIG. 5 is a cross-sectional view schematically showing the completion of the function as an ink jet recording head by removing the solid layer made of a removable material according to an embodiment of the present invention.

With the substrate 1 where the resin layer 5 is formed as described above, it is possible to obtain an ink jet recording head 11 for which the ink inlet 6, ink liquid passage 7, and discharging ports 8 are formed as shown in FIG. 5 by removing the solid layer using a solvent or the like in the next process.

Here, since the ink discharge characteristics vary in accordance with the length of the ink flow passage, it is possible to obtain the head by cutting the discharging port portion in a given position which is determined as an optimal position. Also, it may be possible to remove the solid layer after the discharging port portion is cut. In such a case, when the discharging port portion is cut the solid layer is still in the ink flow passages and others which will occupy the vital portion of the ink Jet system. Thus, the clogging of the ink flow passages due to cut particles, dust particles, and the like and other related problems can be solved. Also, this is preferable because there is an advantage that in this way, the solid layer can be removed in a better condition.

Also, the thickness of the mold resin for the discharging port portion is made thinner than that of the other mold resin portions in order to reduce the stress exerted in the mold resin for the portion where the greatest precision is required in an ink jet recording head. For such a method, it may be possible to make the entire thickness equal until the formation of the mold resin, and then, to make it thinner locally by means of cutting or the like used for the discharging port portion. In this case, a cutting process is additionally required, but when a design consideration is made, there is an advantage in determining the initial thickness of the resin to be used because this contributes to defining the experimental conditions more freely rather than using the dies already established; hence making it possible to obtain more information required for a particular die designing.

Subsequently, a second embodiment will be described.

From FIG. 6 to FIGS. 9A and 9B are schematic views illustrating the fundamental mode of a manufacture method according to the present invention. In each of FIGS. 6 to 9B, the structure of an ink jet recording head according to the method of the present invention and an example of its manufacture procedures are represented. In the present embodiment, while an example of a mode using three discharging ports is shown, the present invention is not limited to this number as in the case of the first embodiment.

Figure 6:
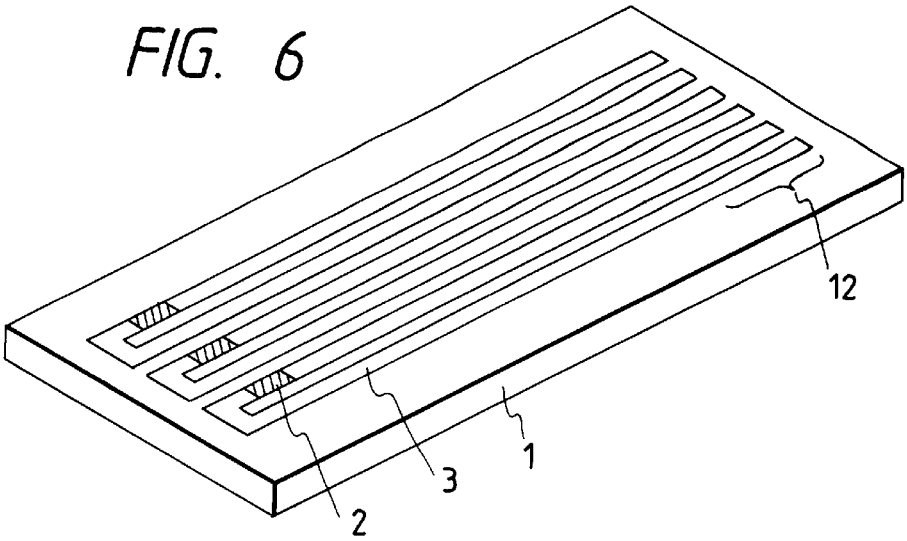
FIG. 6 is a perspective view schematically showing the arrangement of ink discharging energy generating elements on an ink jet recording head substrate according to the sent invention.

In the present embodiment, too, a substrate 1 is prepared substantially in the same way as the first embodiment at first (FIG. 6).

In this respect, control signal input electrodes 3 are connected to the elements 2 arranged on the substrate 1 to drive them.

As the material for the aforesaid electrodes, an Au, Al, Al—Cu—Si, Al—Si, and others can be used. The end portion of the control signal input electrodes opposite to the side where the discharging ports are arranged serves to function as an electrical junction (terminal) 12, and is connected to the recording apparatus main body by an electrical connecting member. The connection is executed by a bonding method using general aluminum wiring or the like. It is, therefore, necessary to prevent scratches, stains, resin flashes, and others from occurring in the aforesaid electrical junction 12.

Also, in general, for the purpose of improving the durability of the aforesaid elements 2 and electrodes 3, various functional layers such as a protective film or the like on the part of the substrate may be provided. There is of course no problem at all in providing various layers of such functions for the elements and electrodes of the present invention.

Figure 7A:
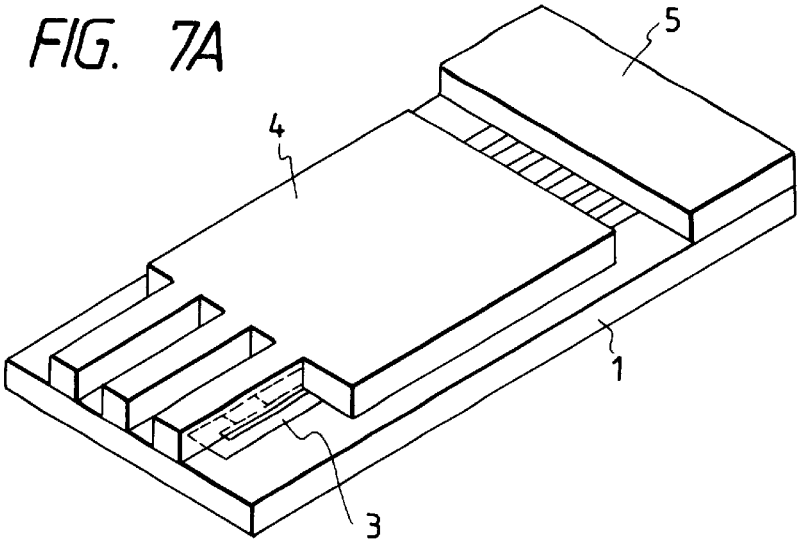
FIGS. 7A and 7B are views showing an example of the substrate where a solid layer is formed on the surface of the elements shown in FIG. 6.
Figure 7B:
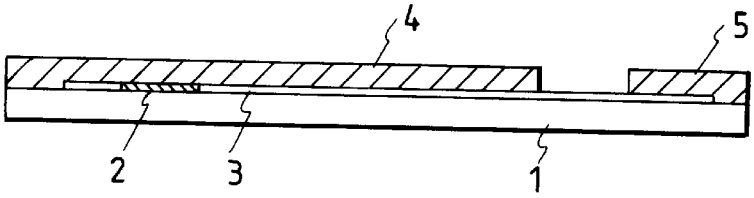

Now, as shown in FIG. 7, on the substrate where the element plane by the method described above, a first solid layer 4 with a pattern for the liquid passages and a liquid chamber formed thereon and a second layer 5 covering the aforesaid electrodes 3 at a given interval to the foregoing first solid layer are laminated. As the solid layers, a resist and others can be used. As a preferable resist, a positive resist, AZ-4000 series (Hexist Japan, Inc.), AZLP series (Hexist Japan, Inc.), PMEP-P-G7000 series (Tokyo Ohka, Inc.) or the like can be used. Also, if the material is only removed after the formation of the molded resin, it is not limited to those mentioned above. The formation of the solid layers on the substrate is made by a known photolithography technique or the like.

Figure 8:
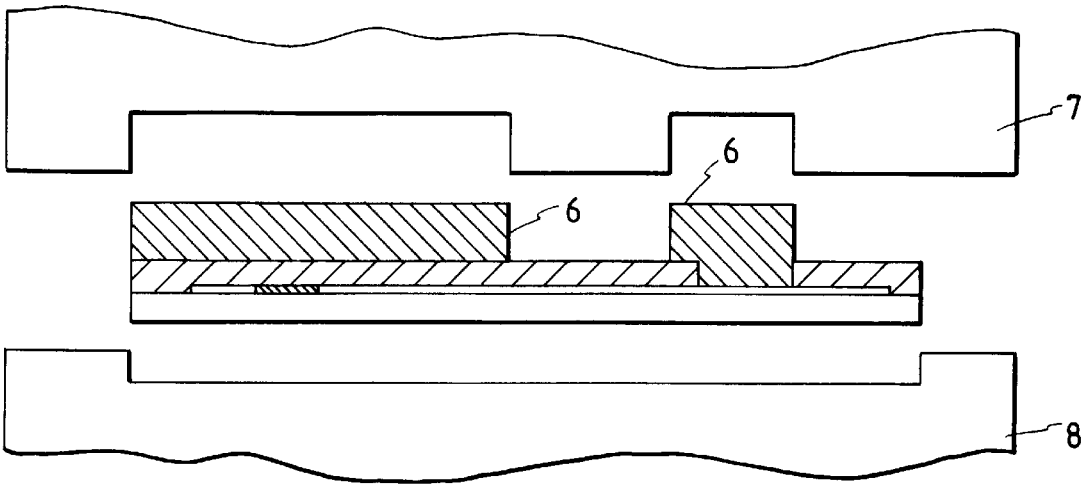
FIG. 8 is a cross-sectional view schematically showing an example where a mold resin layer is formed by inserting a substrate into a metallic die for the transfer mold formation according to the present invention.
Figure 9A:
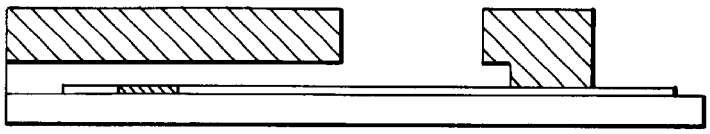
FIGS. 9A and 9B are views showing an example of the ink Jet recording head in which the ink supply inlet, ink liquid chamber, ink liquid passages, and ink discharging ports are completed by removing the solid layer.
Figure 9B:
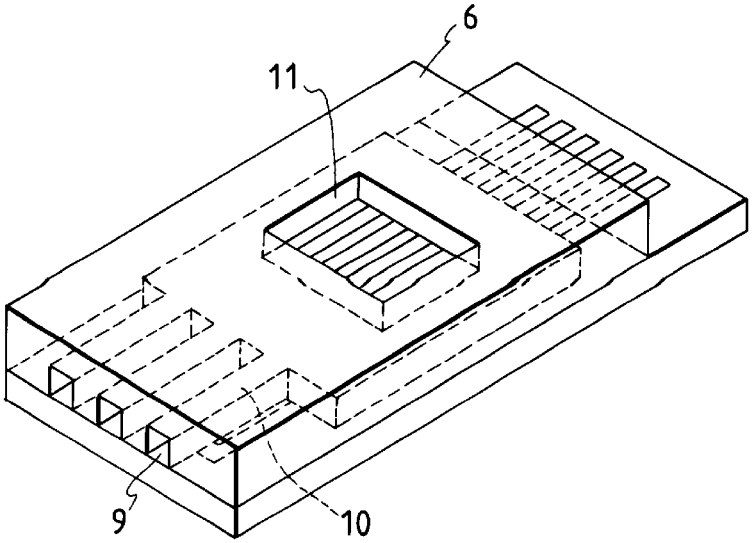

Now, FIG. 8 illustrates the state where a mold resin layer 6 is formed by the application of a transfer mold formation using a formation mold comprising an upper die 7 and a lower die 8 capable of forming the contour of an ink jet recording head and an ink supply inlet.

Here, the description will be made of the transfer molding method. As a process using the transfer mold formation according to the present embodiment, a substrate 1 having the solid layers 4 and 5 formed thereon is inserted into either the upper die 7 or the lower die 8 provided with the arrangement of an appropriate liner, gate and air release. Then, the mold is closed. Using a heat setting epoxy resin as the material for the mold resin 6, the molding is performed in accordance with the general formation condition and process such as the resin preliminary heating at 60° to 90° C.; injection pressure, 20 to 140 Kgf/cm$^2$, formation die temperature, 100° to 180° C., pressurized setting time one to ten minutes, and a post curing after the formation. For the foregoing conditions, the formation characteristics (contour, air bubbles in the resin, burr, flash, and the like) should be ascertained and then, the respective points are defined appropriately. In general, the higher the formation temperature, the shorter is the setting time. Also, the higher the injection pressure, the smaller is the contour stability and the generation of air bubbles. However, any excessive pressure results in a damage to a produce and more problems of burr and flash of the resin. Here, for the timing of the post curing, it is not necessarily executed in continuation with the formation. It may be possible to execute the curing at any point before the product is completely manufactured. Therefore, the post curing can be provided at any stage convenient to the process. It is of course possible to omit this process depending on the state in which the product will be used.

Also, for the purpose of making it easy to remove a product from the molding dies, a mold lubricant may be applied in some cases.

As forming means for the mold resin 6, the transfer mold method is the best suited for the present invention in consideration of its capability for a mass production, precision, and tact. It is of course possible to employ the other methods such as a potting method, a casting method using a liquid resin, an injection method, and a formation method by selective exposure using the resin of an ultraviolet radiation setting type. In any one of the formation methods, there is a need for a measure to prevent scratches, stains, burrs of the mold resin, or the like from occurring on the electrical junction by arranging the upper metallic die for the mold formation so that it is not in contact directly with the substrate.

As the material for the mold resin 6, those used for the first embodiment can be employed.

Then, when the mold resin 6 is completely hardened, the solid layers 4 and 5 are removed to complete an ink jet recording head of the present invention as shown in FIG. 9.

As the method for removing the solid layer, it is preferable to adopt a dissolution method wherein a recording head is immersed in an appropriate solvent so that the solid layer is dissolved and removed. As the solvent, it will suffice if only such a solvent does not destroy the mold resin layer. More specifically, if, for example, the solid layer is made of a positive resist, a caustic soda aqueous solution, and an organic solvent such as acetone or the like can be used. Further, in removal means, if the agitation of the solvent or promotion means such as the use of ultrasonic agitation or the like is adopted together, it is possible to remove the solid layer more efficiently as a matter of course.

Also, since the ink discharging characteristics vary in accordance with the length of the ink liquid passage, there may be a case where the discharging port portion is cut to a desired ink liquid length by a known dicing method applicable to the wafer cutting subsequent to the adjustment of the length of the ink liquid passage in order to improve the ink discharging performance. According to this method, when the discarding port portion is cut, the solid layer is still in the ink flow passages and others which will occupy the vital portion of the ink jet system. Thus, clogging of the ink flow passages due to cut particles, dust particles, and the like and other related problems can be prevented. Also, this is preferable because the length of the ink liquid passages is shortened when the solid layer is removed, and there is an advantage that the removal performance is improved among others.

Now, in conjunction with FIG. 10 to FIG. 12, the description will be made of a third embodiment according to the present invention. In the present embodiment, too, a substrate is prepared in the same manner as the foregoing embodiment.

Then, on the substrate 1 including the above-mentioned ink discharging energy generating elements, a solid layer 2 comprising a removable resist, dry film, or the like is formed. As the resist, the AZ-4000 series (Hexist Japan, Inc.), AZLP series (Hexist Japan, Inc.) or the like can be used. This solid layer 2 is not necessarily limited to a resist so long as the material used is removable.

The formation of the energy generating elements and solid layer on the substrate is performed by a known photolithography or the like.

Also, when the aforesaid solid layer 2 is formed, a solid layer 3 which is also made of the same removable material is formed on the portion where the surface of the elements on the substrate 1, and the metallic die (in the example of the present embodiment, an upper die) used for the transfer mold formation, which will be described later, abut each other.

Figure 11:
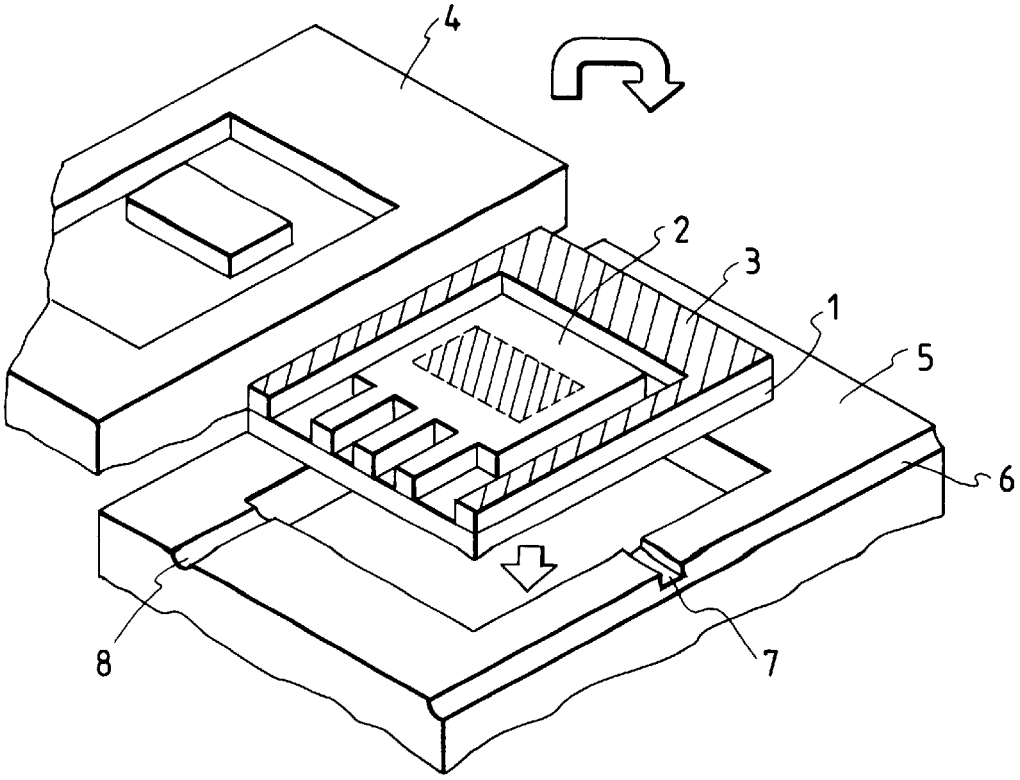
FIG. 11 a perspective view schematically showing the corresponding positions between the substrate having the solid layer on its non-mold portion and the formation die according to an embodiment of the present invention.

FIG. 11 is a view schematically showing the state where a mold resin is formed by inserting a substrate 1 having the aforesaid solid layer formed thereon into the metallic mold (upper die and lower die) used for a transfer mold formation. Here, the portion represented by slanted lines indicates the location of the solid layer 3 on the substrate 1 which is in contact with the upper die 4.

For the transfer mold formation, the materials and method described in the foregoing embodiment are useable. However, irrespective of the kinds of the methods, the present invention demonstrates the effects on the protection of the substrate and the prevention of the defective formation (burrs and flashes of the non-mold part) by forming the solid layer made of material capable of removing the contact between the substrate and the resin or non-mold resin portion completely.

Now, when the mold resin is completely hardened, the solid layers 2 and 3 are removed. In the present embodiment, as the solid layer, a positive resist is used. Therefore, the solid layer can easily be removed by an aqueous solution containing 5 wt % caustic soda or an acetone or other organic solvent. Also, any solvent other than these ones is useable if it has a selectivity (resistance to solvent) with respect to the mold resin. Further, in removal means, if an agitation of the solvent, ultrasonic wave, or other promoting means is added, the removal will be executed more efficiently as a matter of course.

Also, for the adjustment of the ink liquid length to improve the discharging performance, there is also a case where the ink flow length is cut in a desirable length by a known dicing method useable for cutting a wafer.

Figure 12:
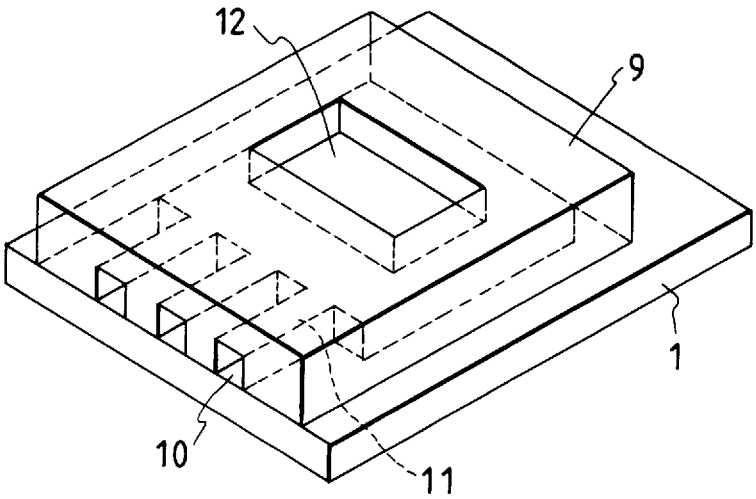
FIG. 12 is a perspective view schematically showing a state where the solid layer is removed after the formation of the mold resin according to an embodiment of the present invention.

FIG. 12 illustrates an ink jet recording head according to the present invention in which the solid layer is removed after the mold formation for the provision of the ink supply inlet 12, ink liquid passages 11 and ink discharging ports 10. In FIG. 12, a reference numeral 1 designates the substrate, and 9, the mold resin layer.

Subsequently, in conjunction with FIG. 13 to FIG. 15, a fourth embodiment will be described.

In the present embodiment, too, a substrate 1 is prepared in the same manner as the foregoing embodiment.

Then, on the substrate 1 including the above-mentioned ink discharging energy generating elements 2 therein, a solid layer 4 is formed by a resist which is removable by a solvent or the like, for example. The solid layer 4 is not necessarily made of a resist. Any material can be used for the purpose provided such a material is removable by some means applicable.

Figure 13:
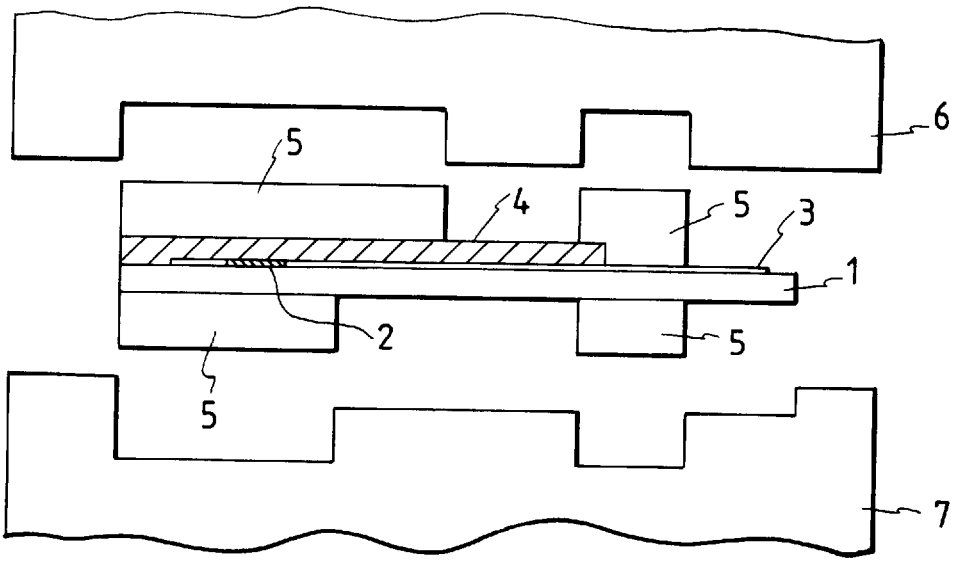
FIG. 13 is cross-sectional view showing the structure of a recording head in a process where the energy generating elements, control signal input electrodes, and solid layer are formed.

Then, as shown in FIG. 13, using a mold capable of forming the outer frame of an ink jet recording head, an ink supply inlet 9, and a hollow hole 10 which is a feature of the present invention, an outer frame 5 is formed by the application of a transfer mold formation.

For the materials and method for executing the transfer mold formation, those used for the foregoing embodiment can be used.

Figure 15:
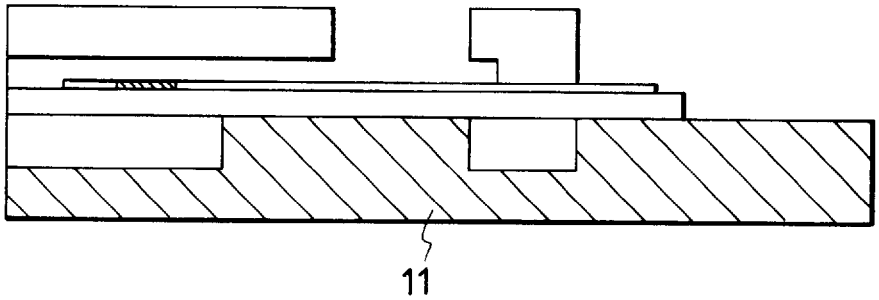
FIG. 15 is a view illustrating the state where a recording head in a process is withdrawn from the formation die after the transfer mold formation.

Then, the removable solid layer 4 is removed after the mold formation, an ink jet recording head of the present invention is obtained as shown in FIG. 15.

As the means for removing the solid layer, there is a method for dissolving it for removal by the use of a caustic soda aqueous solution or an acetone or some other organic solvent if the solid layer is made of a positive resist. The aforesaid solvent is not necessarily limited to those described above provided such a solvent does not destroy the outer frame formation material. Also, an agitation of the solvent, an ultrasonic wave, or some other promotional means is used together, the solid layer can be removed more efficiently as a matter of course.

Here, the ink discharging characteristics vary in accordance with the length of the ink passages. If required, therefore, the discharging port portion is obtained by cutting at a given position by determining an optimal position. The cutting is executed by a known dicing method or the like useable for a wafer cutting.

Also, it is possible to remove the solid layer after the discharging port portion is cut. According to this method, when the discarding port portion is cut, the solid layer is still in the ink flow passages and others which will occupy the vital portion of the ink jet system. Thus, the clogging of the ink flow passages due to cut particles, dust particles, and the like and other related problems can be prevented. Also, this is preferable because the length of the ink liquid passages is shortened when the solid layer is removed, and there is an advantage that the removal performance is improved among others.

Figure 14A:
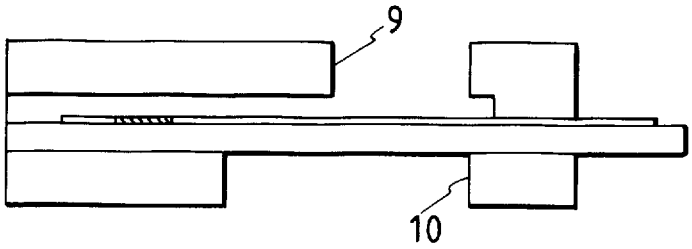
FIGS. 14A and 14B are views showing the structure of the recording head in a process after the solid layer is removed.
Figure 14B:
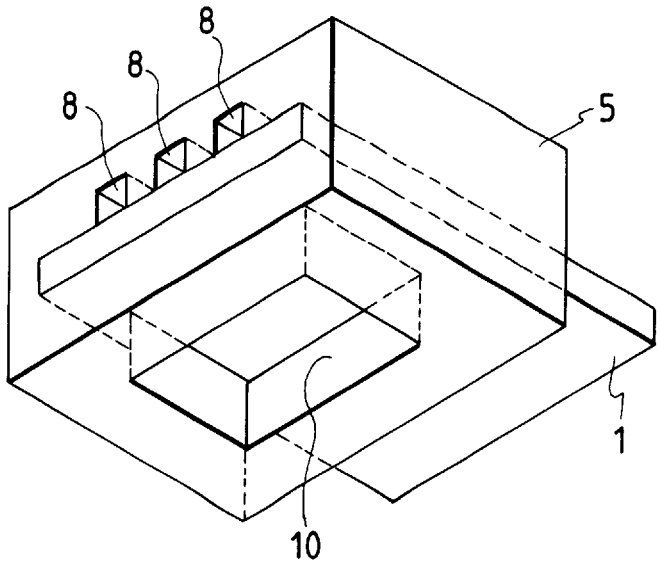

FIGS. 14A and 14B are views illustrating a process in which the substrate 1 and a metallic member 11 are coupled through the hollow hole 10 obtained by the aforesaid formation. In this way, the heat generated in the substrate 1 can be released to the metallic member 11. As the metal material, an Al, stainless steel, SiC, or the like can be named.

In joining the metallic member and the substrate, it is more effective if a silver paste, silicon bound, or some other cement comparatively superior in heat radiation is used mainly for the hollow hole portion.

Also, there is no problem at all in applying usual adhesives to the portions other than the hollow hole in order to enhance the adhesive strength.

Also, the metallic member 11 is used to serve as a connecting part for the recording apparatus. It is also possible to mount the electrical components on the metallic member to drive the head.

Now, in conjunction with FIG. 16 to FIG. 19, a fifth embodiment will be described. In the present embodiment, too, a substrate 1 is prepared in the same manner as the foregoing embodiment.

Then, a solid layer 4 is formed by a removable resist, for example, on the substrate 1 including the above-mentioned ink discharging energy generating elements 2.

For the method of forming the solid layer 4, it is possible to utilize a known method wherein a resist is laminated on the substrate 1, irradiated by light through a mask having the pattern of the solid layer, and developed. For the resist, a known positive or negative one can be used. The above-mentioned solid layer 4 should be dissolved and removed in the latter process as described later. Therefore, the material is not necessarily limited to a resist, but any other material is useable provided such a material is removable.

Figure 16:
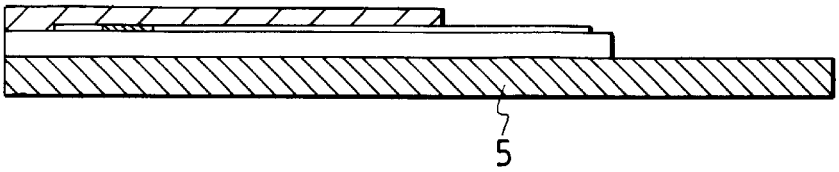
FIG. 16 is a cross-sectional view schematically showing the state where the metal member and the substrate are coupled according to an embodiment of the present invention.

Now, as shown in FIG. 16, the substrate and a metallic member 5 is joined. For the metallic member 5, a metal having a good heat radiation such as aluminum, SiC, SUS, or the like can be used. Also, on the metallic member 5, the electrical components such as ICs, flip chips, and others required to drive the head can be assembled.

The aforesaid metallic member serves to function as a support to the substrate as well as a mounting member for the recording apparatus, and is bonded to the substrate by use of die bonding material, silver paste, silicon powder, UV adhesives, or various other adhesives.

Figure 17:
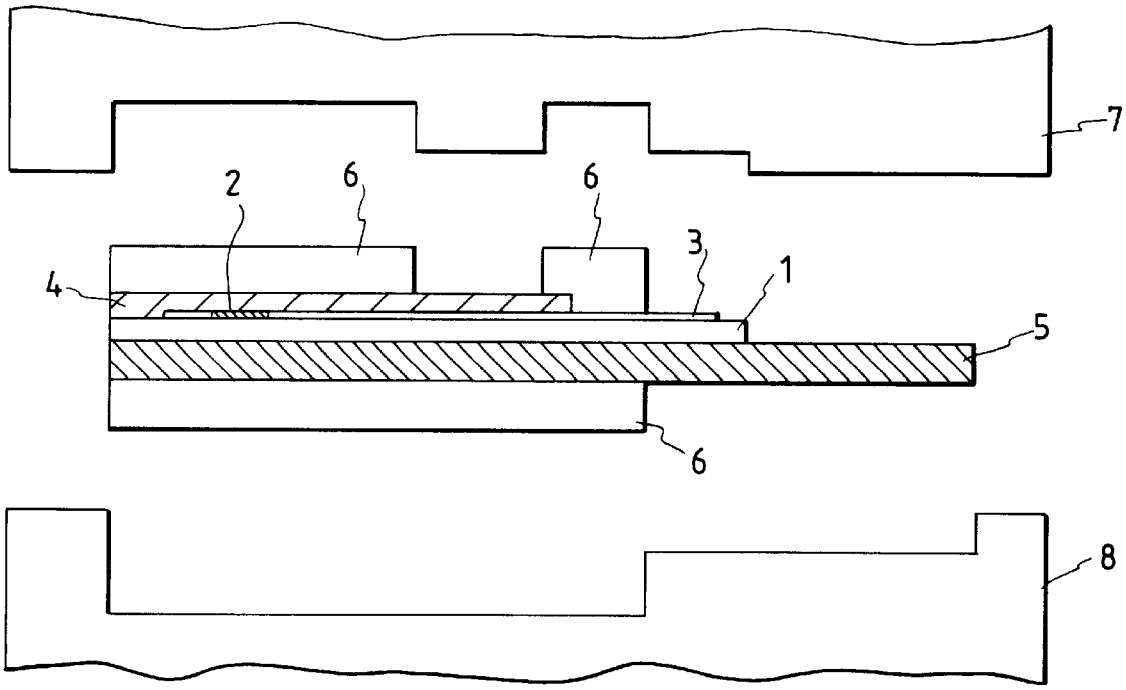
FIG. 17 is a cross-sectional view schematically showing the state where the mold resin is formed by the application of the transfer formation and then, parted from the formation die.

Now, as shown in FIG. 17, using an upper metal die 7 and a lower metal die 8 capable of forming the contour of an ink jet recording head and ink supply inlet, a mold resin layer 6 is formed by the application of a transfer mold formation.

In this respect, for the transfer mold formation and materials, those used for the foregoing embodiment can be used.

Figure 18:
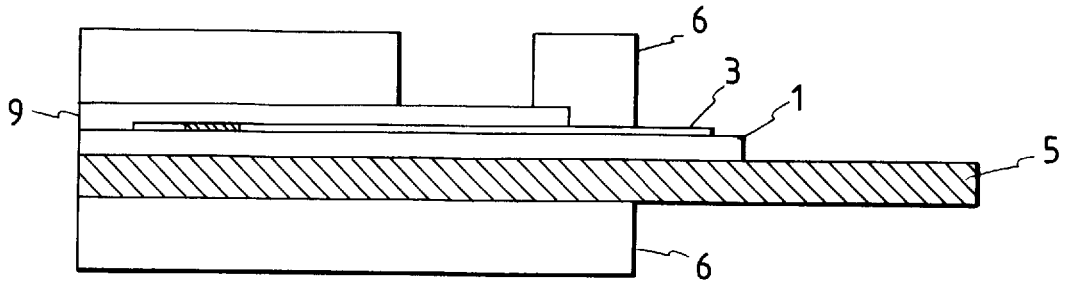
FIG. 18 is a cross-sectional view schematically showing an ink jet head when the solid layer is removed according to an embodiment of the present invention.
Figure 19:
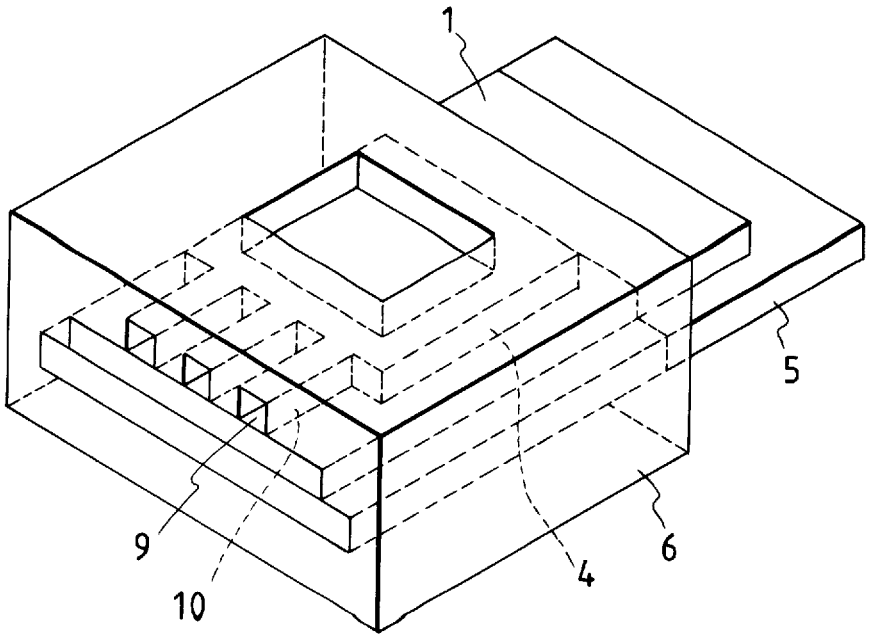
FIG. 19 is a perspective view schematically showing an example of the head structure according to the present invention.

Subsequently, as shown in FIG. 18, the solid layer 4 is removed to complete an ink jet head of the present invention. FIG. 19 is a perspective view illustrating this head. As seen in FIG. 19, the substrate 1, which has both a first side and a second side (which is the back side of the first side), and support member 5 are joined such that the second (back) side of the substrate faces the top side of the support member. The substrate 1 and support member 5 are encased in resin which also forms a liquid path wall, the resin having been transfer molded in part on the substrate and support member. Thus, both the first side of the substrate and bottom side of the support member are coated with resin.

As means for removing the solid layer, it is preferable to use a method wherein the recording head is immersed in an appropriate solvent to dissolve and remove the solid layer. For the appropriate solvent, it is preferable to apply a caustic soda aqueous solution or other alkali aqueous solution if the solid layer is made of a positive resist. Besides, an acetone or other organic solvent can be used.

Also, any other solvents than those mentioned above is applicable, if such a solvent has a selectivity (resistance to solvent) with respect to the mold resin. Further in removal means, if the agitation of the solvent, ultrasonic wave, or some other promoting means is used together, the removal can be executed more efficiently as a matter of course.

Here, the ink discharging characteristics vary in accordance with the length of the ink liquid passage. If required, therefore, it may be possible to adjust the length of the liquid passage in order to improve the ink discharging performance, and cut the discharging port portion to a desired length of the liquid passage by a known dicing method or the like usable as a method for cutting wafers.

According to the present invention, it is possible to remove the solid layer after the discharging port portion is cut. This method prevents cutting particles, dusts, and other from entering the ink liquid passages which occupy an important role in an ink jet recording head because when the discharging port portion is cut, the passages are filled with the solid layer. In addition, since the solid layer is removed after the liquid passages, there is an advantage that the solid layer removal is performed in a better condition.

Now, in conjunction with FIG. 20 to FIG. 24, the description will be made of a sixth embodiment according to the present invention.

Figure 20:
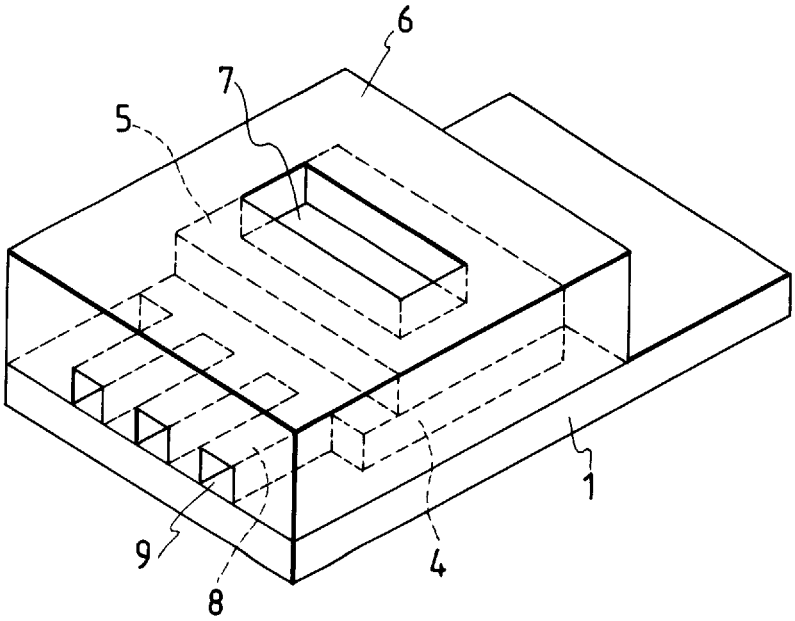
FIG. 20 is a perspective view schematically showing a structural example of an ink jet head according to the present invention.

In this respect, FIG. 20 is a perspective view showing an ink jet recording head obtained by the present embodiment. In the present embodiment, too, a substrate 1 is prepared in the same manner as the foregoing embodiment.

Figure 21:
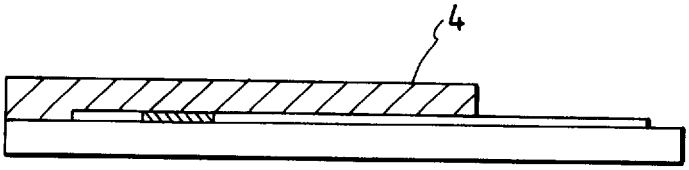
FIG. 21 is a cross-sectional view schematically showing the state where a pattern for ink liquid passages and an ink liquid chamber is formed by a solid layer for the liquid passage formation according to an embodiment of the present invention.

Then, as shown in FIG. 21, a solid layer 4 made of a removable resist, for example, is formed for the liquid passage formation on the substrate 1 including the above-mentioned ink discharging energy generating elements 2.

As the method forming the solid layer 4 for the formation of the liquid passages, it is possible to adopt a known method wherein a resist is laminated on the substrate 1, and developed after it is irradiated by light through a mask having the pattern for the solid layer. As the resist, a known positive or negative one can be utilized. As described later, the above-mentioned solid layer 4 should be dissolved and removed in a latter process. Therefore, the material is not necessarily limited to a resist. Various other materials can be used if only such a material is removable.

Figure 22:
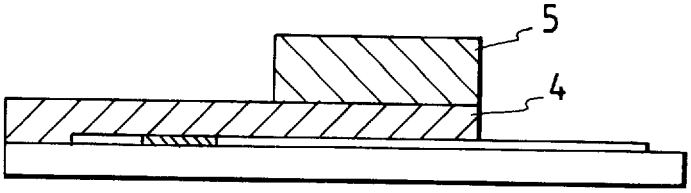
FIG. 22 is a cross-sectional view schematically showing the state where a solid layer for the formation of the liquid chamber is formed by a screen printing on the portion of a substrate where the formation of the ink liquid chamber is anticipated according to an embodiment of the present invention.

In continuation, as shown in FIG. 22, a solid layer 5 for the formation of a liquid chamber is provided on the portion on the substrate where the formation of a liquid chamber is anticipated.

As the material for the solid layer 5 for the formation of the liquid chamber, it may be possible to adopt the same material as the one used for the solid layer 4 for the formation of the liquid passages or a different material. Further, the method for forming the solid layer 5 for the formation of the liquid chamber is the same as the one used for the solid layer 4 for the formation of the liquid passages. Moreover, it may be possible to form the solid layer 5 for the formation of the liquid chamber ahead of the formation of the liquid passages.

It is preferable to make the solid layer 5 for the formation of the liquid chamber two to ten times the thickness of the solid layer 4 for the formation of the liquid passages from the viewpoint of a desirable ink supply.

Figure 23:
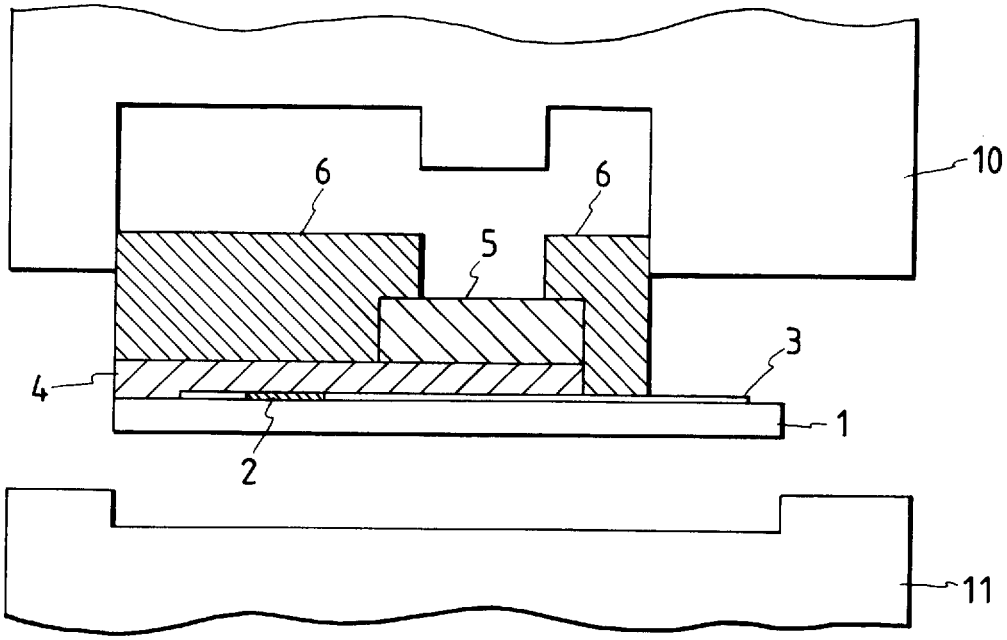
FIG. 23 is a cross-sectional view schematically showing the state where a mold resin layer is formed by the application of transfer mold formation according to an embodiment of the present invention.

After the completion of the formation of the solid layers 4 and 5, as shown in FIG. 23, a mold resin layer 6 is formed by the application of a transfer mold formation using the upper forming die 10 and a lower forming die 11 capable of forming the outer contour of a recording head and ink supply inlet. In this respect, the method and material used for the transfer mold formation are the same as those applicable to the foregoing embodiment.

Figure 24:
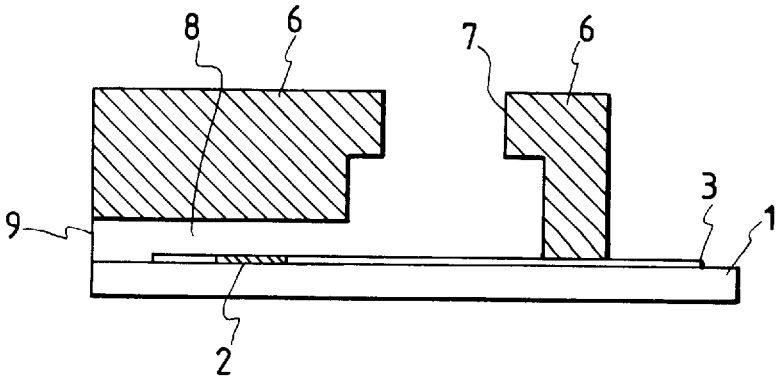
FIG. 24 is a cross-sectional view schematically showing the completion of the functions as an ink jet head by removing the solid layer according to an embodiment of the present invention.

Then, the solid layers 4 and 5 are removed to complete an ink jet recording head having the ink supply inlet, ink liquid chamber, ink liquid passages, and ink discharging ports as shown in FIG. 24.

As means for removing the solid layers, it is preferable to use a method wherein a recording head is immersed in an appropriate solvent to dissolve and remove the solid layers. The appropriate solvent, it is preferable to use a caustic soda aqueous solution if the solid layers are made of a positive resist. Besides, acetone or other organic solvent is applicable. Furthermore, any other solvent other than those mentioned above can be used if only such a solvent does not destroy the mold resin.

Further, in removal means, it is possible to remove the solid layers more efficiently if the agitation of the solvent, ultrasonic wave, or other promoting means is employed together as a matter of course.

In each of the above-mentioned embodiments, the solid layer for the formation of the liquid passages and the solid layer for the formation of the liquid chamber are formed as an integrated solid layer, but these may be separate layers, or may be formed in the different processes.

Also, in each of the embodiments, only three flow passages are represented, but the present invention is equally applicable to a multi type which has many more flow passages and to a full-line type in which a plurality of flow passages are formed correspondingly to the recordable width of a recording medium.

Also, in each of the embodiments, the elemental techniques are described individually as required, but these can be practiced complexly.

The present invention produces an excellent effect on ink jet recording methods, particularly a recording head and a recording apparatus wherein the flying droplets are formed by utilizing thermal energy in order to perform recording.

Regarding the typical structure and operational principle of such a method, it is preferable to adopt those which can be implemented using the fundamental principle disclosed in the specifications of U.S. Pat. Nos. 4,723,129 and 4,740,796. This method is applicable to the so-called on-demand type recording system and a continuous type recording system. Particularly, however, it is suitable for the on-demand type because the principle is such that at least one driving signal, which provides a rapid temperature rise beyond a departure from nucleation boiling point in response to recording information, is applied to an electrothermal transducer disposed on a liquid (ink) retaining sheet or liquid passage whereby to cause the electrothermal transducer to generate thermal energy to produce film boiling on the thermoactive portion of the recording head; thus effectively leading to the resultant formation of a bubble in the recording liquid (ink) one to one for each of the driving signals. By the development and contraction of the bubble, the liquid (ink) is discharged through a discharging port to produce at least one droplet. The driving signal is preferably in the form of pulses because the development and contraction of the bubble can be effectuated instantaneously, and, therefore, the liquid (ink) is discharged with quick response. The driving signal in the form of pulses is preferably such as disclosed in the specifications of U.S. Pat. Nos. 4,463,359 and 4,345,262. In this respect, the temperature increasing rate of the heating surface is preferably such as disclosed in the specification of U.S. Pat. No. 4,313,124 for an excellent recording in a better condition.

The structure of the recording head may be as shown in each of the above-mentioned the specifications wherein the structure is arranged to combine the discharging ports, liquid passages, and the electrothermal transducers as disclosed in the above-mentioned patents (linear type liquid passage or right angle liquid passage). Besides, the structure such as disclosed in the specifications of U.S. Pat. Nos. 4,558,333 and 4,459,600 wherein the thermal activation portions are arranged in a curved area is also included in the present invention.

In addition, the present invention is applicable to the structure disclosed in Japanese Patent Laid-Open Application No. 59-123670 wherein a common slit is used as the discharging ports for plural electrothermal transducers, and to the structure disclosed in Japanese Patent Laid-Open Application No. 59-138461 wherein an opening for absorbing pressure wave of the thermal energy is formed corresponding to the discharging ports.

Moreover, as the recording head for which the present invention is effectively utilized, there is a recording head of a full-line type having a length corresponding to the maximum width of a recording medium recordable by a recording apparatus. This full-line head may be the one structured by combining a plurality of the recording heads disclosed in the above-mentioned specifications or a single full-line recording head which is integrally formed.

Figure 25:
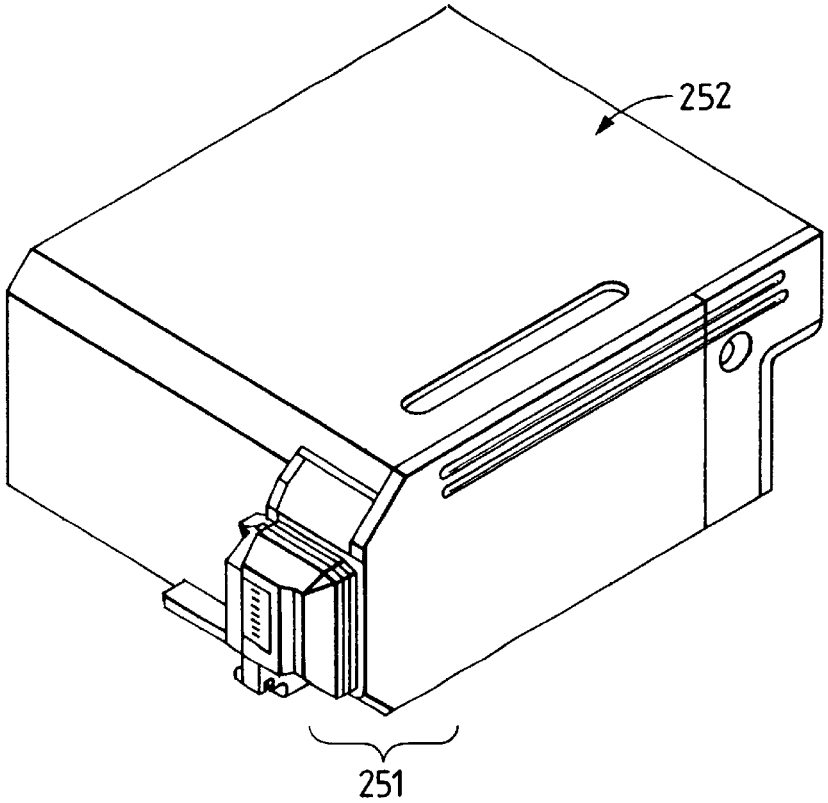
FIG. 25 is a view illustrating an ink jet cartridge according to the present invention.

In addition, the present invention is effectively applicable to a replaceable chip type recording head which is electrically connected with the main apparatus and for which the ink is supplied when it is mounted in the main assemble; or to a cartridge type recording head as shown in FIG. 25 having an ink tank 252 integrally provided for the recording head 251 itself.

Also, it is preferable to provide recording head recovery means and preliminarily auxiliary means additionally for a recording apparatus according to the present invention because these additional means will contribute to making the effectiveness of the present invention more stabilized. To name them specifically, such means are capping means for the recording head, cleaning means, compression or suction means, preliminary heating means such as electrothermal transducers or heating elements other than such transducers or the combination of those types of elements, and the preliminary discharge mode aside from the regular discharging for recording.

Further, as the recording mode of the apparatus, the present invention is extremely effective in applying it not only a recording mode in which only main color such as black or the like, but also to an apparatus having at least one of a multi-color mode with ink of different colors, or a full-color mode using the mixture of the colors, irrespective of whether the recording head is integrally structured or it is structured by a combination of plural recording heads.

Now, in the embodiments according to the present invention set forth above, while the ink has been described as liquid, it may be an ink material which is solidified below the room temperature but liquefied at the room temperature. Since the ink is controlled within the temperature not lower than 30° C. and not higher than 70° C. to stabilize its viscosity for the provision of the stable ejection in general, the ink may be such that it can be liquefied when the applicable recording signals are given.

In addition, while positively preventing the temperature rise due to the thermal energy by the use of such energy as an energy consumed for changing states of ink from solid to liquid, or using the ink which will be solidified when left intact for the purpose of preventing ink evaporation, it may be possible to apply to the present invention the use of an ink having a nature of being liquefied only by the application of thermal energy such as an ink capable of being ejected as ink liquid by enabling itself to be liquefied anyway when the thermal energy is given in accordance with recording signals, an ink which will have already begun solidifying itself by the time it reaches a recording medium.

In the present invention, the most effective method for the respective ink mentioned above is the one which is capable of implementing the film boiling method described above.

Figure 26:
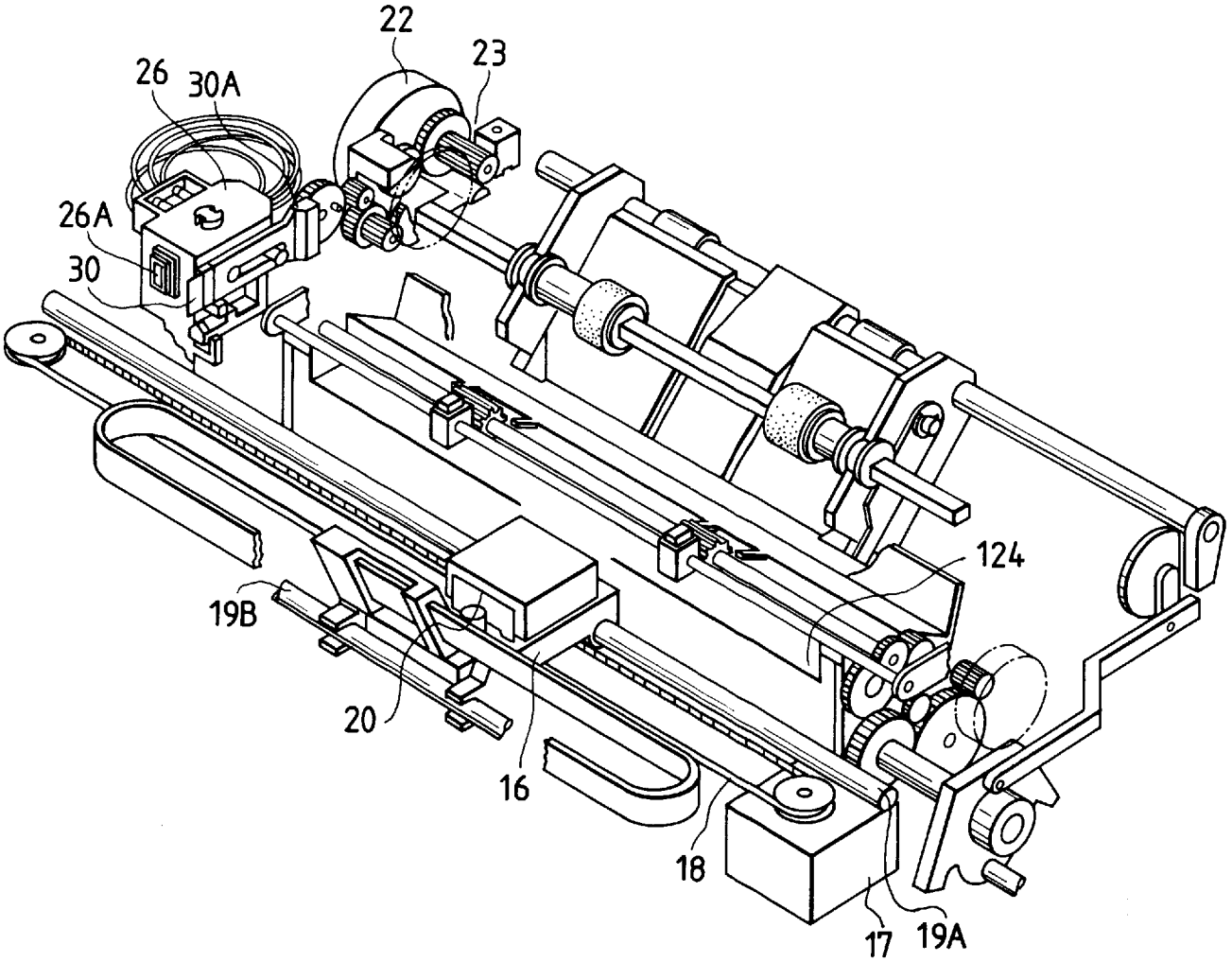
FIG. 26 is a perspective view schematically illustrating a recording apparatus provided with an ink jet head according to the present invention.

FIG. 26 is a perspective view showing the outer appearance of an example of the ink jet recording apparatus (IJRA) to which a liquid jet recording head obtainable by the present invention is bonded as an ink jet cartridge (IJC).

In FIG. 26, a reference numeral 20 designates an ink jet cartridge (IJC) provided with the nozzle group which discharges ink onto the recording surface of a recording sheet fed on a platen 24; and 16, a carriage HC holding the IJC 20, which is partly coupled to a driving belt 18 transmitting the driving force of a driving motor 17, and slidably mounted on the two guide shafts 19A and 19B arranged in parallel, thus enabling the IJC 20 to reciprocate along the entire width of the recording sheet.

A reference numeral 26 is a head recovery device which is arranged at one end of the traveling passage of the IJC 20, that is, a location opposite to its home position, for example. The head recovery device 26 is driven by the driving force of a motor 22 through a transmission mechanism 23 in order to cap the IJC 20. Interlocked with the capping operation for the IJC 20 by a cap unit 26A of this head recovery device 26, an ink suction is executed by an appropriate suction means provided in the head recovery device 26 or the pressurized ink feeding is actuated by an appropriate pressure means provided in the ink supply passage to the IJC 20. Thus, the ink is forcibly exhausted from the discharging ports to execute a discharge recovery process such as the removal of any overly viscous ink in the nozzles. Also, when the recording operation is terminated, the capping is performed to protect the IJC 20.

A reference numeral 30 designates a wiping blade made of a silicon rubber, which is arranged at the side end of the head recovery device 26. The blade 30 is held by a blade holding member 30A in a cantilever fashion, and is driven by the motor 22 and the transmission mechanism 23 in the same manner as in the head recovery device 26; hence enabling it to engage with the discharging surface of the IJC 20. In this way, the blade 30 is allowed to extrude in the traveling passage of the IJC 20 at an appropriate timing during the recording operation of the IJC 20 or subsequent to the discharging recovery process using the head recovery device 26 in order to wipe the dews, wets, or dust particles on the discharging surface of the IJC 20 along the traveling of the IJC 20.

(Embodiment 1)

Hereinafter, with reference to the first embodiment, the present invention will be described more specifically.

For a substrate I described in FIG. 2, a silicon wafer is used. On the substrate 1, electrothermal transducers 2 (heaters made of $HfB_2$) and electrodes 3 (made of Al) corresponding to the aforesaid electrothermal transducers 2 are formed in film by a deposition, sputtering, etching, or other semiconductor processing, and arranged at predetermined intervals so that the entire surface thereof becomes an element plane.

Further, although not shown in FIG. 2, a protective film and various other functional films are provided for the element plane including each of the electrodes 3 and electrothermal transducers 2, respectively, for the purpose of improving the durability.

On the aforesaid substrate 1, a positive resist is coated by a spinner coating in a given thickness. Then, using a mask pattern for ink liquid passages corresponding to the respective electrothermal transducers 2 and a liquid chamber, a solid layer 4 is formed through an exposure and a development process.

Subsequently, the substrate 1 where the solid layer 4 is formed is molded by the application of a transfer mold formation.

In a process using the transfer mold formation according to the present embodiment, the substrate 1 where the solid layer 4 is formed is inserted into either an upper die or a lower die comprising a cavity provided with an appropriate runner, a gate, and an air escape arrangement. Then, the mold is closed. As the material for the mold resin 5, a heat setting epoxy resin is used; hence making it possible to execute this process in accordance with a general formation condition and processing technique such as the resin preliminary heating temperature, 60° to 90° C., injection pressure, 20 to 140 kgf/cm$^2$, formation temperature, 100° to 180° C., pressurized setting time, one to ten minutes, and then, a post curing. For the aforesaid conditions, it will suffice if only the formation characteristics (configuration, air bubbles in the resin, burr, flash and others) are ascertained, and an appropriate point is established as required, respectively. In general, the higher the formation temperature, the shorter is the setting time. Also, the higher the injection pressure, the smaller is the configuration stability as well as the generation of air bubbles. However, any excessive pressure will lead to the creation of problems such as a damage to the product, burrs and flashes. Here, as the timing for a post curing, it is not necessarily executed in continuation with the formation. It is good enough if only the post curing is performed at any stage before the completion of the product. Therefore, this process can be arranged in a stage convenient to executing it. Depending on the state in which the product is used, this process can be omitted as a matter of course.

Also, in order to make it easier for the product to be parted from the mold after the formation, there is a case where a mold lubricant is applied. In the present embodiment, the preliminary heating temperature is set at 85° C., the injection pressure, 70 kgf/cm$^2$, formation temperature, 150° C., and pressurized setting time, four minutes. Also, the resin used is a heat setting epoxy resin NT-8506 (Nitto Inc.).

Here, the thickness of the mold resin for the discharging port portion and the ink flow passage portion, which constitutes the point of the present invention, is set at 0.2 mm or more from the surface of the substrate 1, and a ½ or less of the thickness of the mold resin in the other portion in consideration of the mechanical strength and the relaxation of the stress of the mold resin. It is ascertained that this thickness arrangement demonstrates the best effect according to the experiment. Therefore, the molding dies are designed to obtain the aforesaid dimensions, and using them for the mold formation, the required configuration can be obtained all together at that time.

Subsequently, the discharging port portion is cut by a known dicing method applicable to a wafer cutting in a given length of the ink flow passage, hence obtained a desired discharging port position.

Then, the solid layer 4 made of the aforesaid removable material is removed. In the present embodiment, a positive resist (Product name: AZ-4903 manufactured by Hexist Japan, Inc.) is used for the solid layer 4. Therefore, a 5 wt % caustic soda aqueous solution, or acetone or other organic solvent, can be used for the purpose. Also, as a solvent applied to the removal, any others may be usable if only such a solvent has a selectivity with respect to the mold resin. In removing means, it is needless to mention that the removal can be executed more efficiently if the agitation of a solvent, ultrasonic wave, or other promoting means is used together.

(Embodiment 2)

Figure 27:
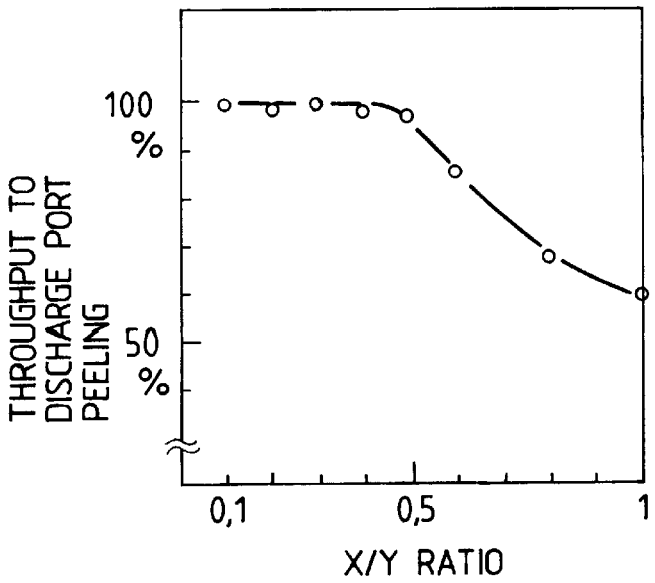
FIG. 27 is a graph showing the relationship between the mold thicknesses and the peeling frequency of the discharging ports.

In FIG. 27, there are shown the results of measurement given to the frequency with which the peeling of the discharging ports occurs by varying the ratio (X/Y) of the mold thicknesses.

Hereinafter, with referent to the second embodiment, the present invention will be described more specifically.

For a substrate 1 described in FIG. 6, a silicon wafer is used. On the substrate 1, electrothermal transducers (heaters made of $HfB_2$) and electrodes 3 (made of Al) corresponding to the aforesaid electrothermal transducers 2 are formed in film by a deposition, sputtering, etching, or other semiconductor processing, and arranged at predetermined intervals so that the entire surface thereof becomes an element plane.

Further, although not shown in FIG. 6, a protective film and various other functional films are provided for the element plane including each of the electrodes 3 and electrothermal transducers 2, respectively, for the purpose of improving the durability.

Then, on the aforesaid substrate 1, a positive resist is coated by a spinner coating in a given thickness, and using a mask pattern for ink liquid passages corresponding to the respective electrothermal transducers 2 and a liquid chamber, a solid layer 4 is formed through an exposure and a development process as shown in FIG. 7.

At the same time, then, a solid layer 5 is formed in the same manner on the electrical junction on the substrate.

Subsequently, the substrate 1 having the aforesaid solid layers 4 and 5 formed thereon is inserted into a transfer mold formation equipment to form a mold resin layer made of an epoxy resin. The formation condition is the preliminary heating is 80° C., preliminary heating injection pressure, 70 Kgf/cm$^2$, formation temperature 150° C., and pressurized setting time, four minutes.

After the mold resin is hardened, the solid layers are dissolved and removed by a 5 wt % caustic soda aqueous solution to complete an ink jet recording head of the present invention.

(Embodiment 3)

Hereinafter, with reference to the third embodiment, the present invention will be described more specifically.

Figure 10:
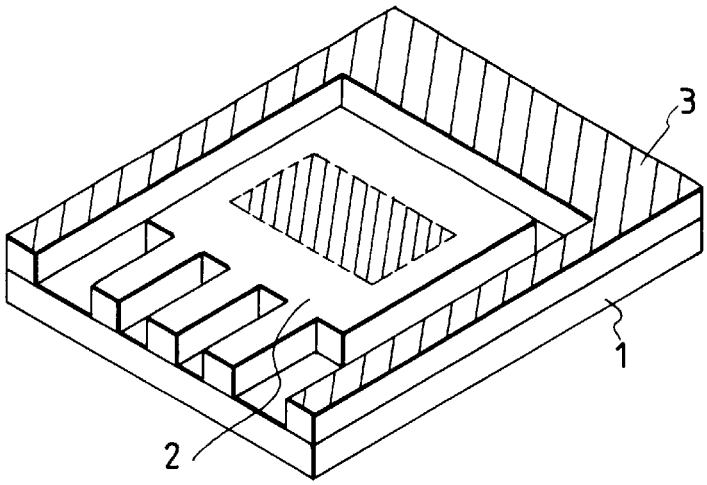
FIG. 10 is a perspective view schematically showing the portion where the solid layer provided on the substrate and the metallic die for the transfer mold formation abut on each other according to an embodiment of the present invention.

For a substrate 1 described in FIG. 10, a silicon wafer is used. On the substrate 1, electrothermal transducers 2 (heaters made of $HfB_2$) and electrodes 3 (made of Al) corresponding to the aforesaid electrothermal transducers 2 are formed in film by a deposition, sputtering, etching, or other semiconductor processing, and arranged at predetermined intervals so that the entire surface thereof becomes an element plane.

Further, although not shown in FIG. 10, a protective film and various other functional films are provided for the element plane including each of the electrodes 3 and electrothermal transducers 2, respectively, for the purpose of improving the durability.

Then, on the aforesaid substrate 1, a positive resist is coated by a spinner coating in a given thickness, and using a mask pattern for ink liquid passages corresponding to the respective electrothermal transducers 2 and a liquid chamber, a solid layer 2 is formed through an exposure and a development process as shown in FIG. 11.

At the same time, then, in order to form also a portion where the metal dies used for the transfer mold formation, which will be described later, and the substrate 1 abut each other, that is, a portion corresponding to the non-mold portion, the aforesaid mask pattern is arranged, and a solid layer 3 shown in FIG. 10 is also formed simultaneously.

Subsequently, the substrate 1 having the aforesaid solid layers 2 and 3 formed thereon is inserted into a transfer mold formation equipment to form a mold resin layer made of an epoxy resin. The formation condition is the preliminary heating is 80° C., preliminary heating injection pressure, 70 Kgf/cm$^2$, formation temperature 150° C., and pressurized setting time, four minutes.

After the mold resin is hardened, the solid layers are dissolved and removed by a 5 wt % caustic soda aqueous solution to complete an ink jet recording head of the present invention (FIG. 12).

(Embodiment 4)

Hereinafter, with reference to the fourth embodiment, the present invention will be described more specifically.

On a substrate made of a silicon wafer, electrothermal transducers (heaters made of $HfB_2$) and electrodes (made of Al) corresponding to the aforesaid electrothermal transducers are filmed by sputtering and formed by a pattern formation method using the photolithography technique to obtain an element plane.

Then, a protective film made of $SiO_2$ is provided on the aforesaid element plane.

Subsequently, on the protective film, a positive resist is spin coated in a thickness equal to the height of the ink discharging ports. Then, using a pattern mask for the ink passages corresponding to the respective electrothermal transducers, and an ink chamber, a solid layer 4 is formed through an exposure and development process.

Then, using a heat setting epoxy resin as the material for an outer frame formation, the outer frame which has a hollow hole is formed by the application of a transfer mold formation on condition of a preliminary heating at 80° C. which uses a general microwave; injection pressure, 60 $Kgf/cm^2$; formation temperature, 150° C.; and pressurized setting time, four minutes.

After the transfer formation, the aforesaid product in process is immersed in a 5 wt % caustic soda aqueous solution to dissolve and remove the solid layer made of a positive resist thereby to obtain the ink chamber, ink passages, and ink supply inlet.

Subsequently, through the hollow portion formed by the application of the transfer formation, the substrate and a metallic member made of Al are adhesively bonded using a silicon compound (SH-340: Toray silicone, Inc., for example), thus obtaining an ink jet head of the present invention.

(Embodiment 5)

Hereinafter, with reference to the fifth embodiment, the present invention will be described more specifically.

For a substrate 1 described in FIG. 16, a silicon wafer is used. On the substrate 1, electrothermal transducers 2 (heaters made of $HfB_2$) and electrodes 3 (made of Al) corresponding to the aforesaid electrothermal transducers 2 are formed in film by a deposition, sputtering, etching, or other semiconductor processing, and arranged at predetermined intervals so that the entire surface thereof becomes an element plane.

Further, although not shown in FIG. 16, a protective film and various other functional films are provided for the element plane including each of the electrodes and electrothermal transducers, respectively, for the purpose of improving the durability.

Then, on the aforesaid substrate 1, a positive resist is coated by a spinner coating in a given thickness, and using a mask pattern for ink liquid passages corresponding to the respective electrothermal transducers 2 and a liquid chamber, a solid layer 4 is formed through an exposure and a development process.

Subsequently, the substrate 1 having the solid layer 4 formed thereon and a metallic member 5 (in the present embodiment, aluminum is used) are bonded in a given position.

Then, the substrate 1 bonded with the aforesaid metallic member 5 is inserted into a transfer mold formation apparatus to form a mold resin.

The formation condition is: preliminary heating temperature, 80° C.; injection pressure, 70 $Kgf/cm^2$; formation temperature, 150° C.; and pressurized setting time, four minutes.

Then, after the mold resin 6 is hardened, the solid layer 4 is removed. In the present embodiment, since a positive resist is used, the layer is dissolve and removed by the application of a 5 wt % caustic soda aqueous solution.

(Embodiment 6)

Hereinafter, with reference to the sixth embodiment, the present invention will be described more specifically.

(Embodiment 6-1)

For a substrate 1 described in FIG. 16, a silicon wafer is used. On the substrate 1, electrothermal transducers 2 (heaters made of $HfB_2$) and electrodes 3 (made of Al) corresponding to the aforesaid electrothermal transducers 2 are formed in film by a deposition, sputtering, etching, or other semiconductor processing, and arranged at predetermined intervals so that the entire surface thereof becomes an element plane.

Further, although not shown in FIG. 16, a protective film and various other functional films are provided for the element plane including each of the electrodes 3 and electrothermal transducers 2, respectively, for the purpose of improving the durability.

Then, on the aforesaid substrate 1, a positive resist is coated by a spinner coating in a given thickness, and using a mask pattern for ink liquid passages corresponding to the respective electrothermal transducers 2 and a liquid chamber, a solid layer 4 is formed through an exposure and a development process.

Subsequently, using a screen printing board where a pattern of the portion corresponding to a liquid chamber portion, a solid layer 5 for the formation of a liquid chamber is formed by the application of a printing method using a water soluble solder resist (Product name: Solder mask resist TC-564—S-SN: Sun-nopco, Inc.) in the present embodiment. Here, in the present embodiment, the screen printing method is employed as means to form the solid layer 5, but the method is not limited thereto. If the method has means capable of executing the required formation without damaging the configuration of the solid layer 4, it may be possible to adopt a transfer method, stamp method, or the like without any problem, for example. The important point of the present invention is that at least the portion corresponding to the ink chamber is formed higher than that of the ink discharging port and ink liquid passage portions. This characterizes the present invention, and formation means to achieve this is not particularly limited.

Then, the substrate 1 where the solid layer 5 is formed is inserted into a transfer fold formation apparatus to form a mold resin layer 6. The formation condition is: using an epoxy resin as the mold resin, a preliminary heating in given at 80° C.; formation temperature, 150° C.; injection pressure, 70 $Kgf/Cm^2$; and pressurized setting time, 120 minutes.

Subsequently, the discharging port portion is cut in a given length of the ink liquid passage by the application of a known dicing method usable for wafer cutting to obtain the discharging port surface.

Then, the solid layers 4 and 5 are dissolved and removed by the use of a 5 wt % caustic soda aqueous solution to obtain an ink jet head of the present invention.

(Embodiment 6-2)

As the formation material for the solid layer for the formation of liquid flow passages, a water soluble negative dry film (hereinafter referred to as nega DF) is used to laminate the nega DF by a laminator on the substrate where the element plane is formed. Then, using a given pattern mask, the solid layer for the formation of the liquid flow passages is formed through exposure, and development.

Then, on the solid layer for the formation of the liquid flow passages, the nega DF is again laminated to form a solid layer for the formation of the liquid chamber through exposure and development using a given pattern mask corresponding to the ink chamber.

With the exception of the solid layer formation method, an ink jet recording head is manufactured in the same manner as the Embodiment 1.

(Effects of the Invention)

The effects produced by the present invention set forth above can be itemized as follows:

1) Since the main processes to manufacture the head are executable by the photolithography technique using a photoresist, dry film, or the like, it is possible to form the minute portion of the head by use of a desired pattern with an extreme ease. It is also easy to process many heads of the same structure at a time.

2) The discharging port portion is a vital part for the head, which requires precision, accuracy, and reliability. It is possible to obtain the configuration of the discharging port portion (changing the thickness of the resin locally) at the time of a mold formation without any particular process provided for the aforesaid portion. Therefore, the stress exerted in the resin can be minimized. Thus, it is possible to obtain a highly reliable head having an excellent property suitable for the cutting process required for the discharging port portion as well as for the secure adhesion between the resin and the substrate.

3) When the discharging port portion is cut, the cutting particles of the resin results in clogging the cutting blade if the mold resin is thick, leading to the lowered yield due to the cut off, scratches, or the like occurring on the surface of the discharging port surface. By thinning the mold resin, this problem can be solved. Also, the life of the blade is prolonged.

4) The formation of the principal members to constitute the head can be made by the mold formation using the transfer mold formation method. As a result, it is possible to provide a head excellent in the adhesiveness to the substrate, strength, and resistance to heat easily at a low cost.

5) Irrespective of the size of the head and the number of the discharging ports, it is possible to obtain a high density multi-array head by simple means in an excellent yield.

6) It is possible to provide a highly reliable electrical junction without any particular process additionally required because the protection of the electrical junction can be arranged at the time of the formation.

7) Without any particular process additionally required, the non-mold portion on the surface of the substrate can be protected, thus enabling the provision of a highly reliable head in an excellent yield by preventing any resultant scratches and damages.

8) It is possible to provide a head having a desirable precision and high quality without setting any rigid tolerance. As a result, an inexpensive head can be provided.

9) A removable solid layer is arranged on the non-mold portion where burrs and flashes are generated at the time of formation. It is possible to remove these burrs and flashes together with the solid layer, hence enabling the provision of a high quality head which has an excellent plastic property.

10) There is an advantage that the hollow hole can be a mechanism to position a substrate and a metallic member when coupled.

11) Since a substrate is directly in contact with a metallic member, it is possible to allow the heat energy due to the heat generation by the energy generating elements to be escaped to the outside at the time of ink discharging. Therefore, no peeling takeplace due to the difference in the coefficient of the thermal contraction between the substrate and the resin of a setting type.

12) Further, when many numbers of energy generating elements are arranged, the head has an excellent capability to radiate heat. Therefore, there is an advantage that a stable discharging is obtainable for a long time.

13) Since the substrate and the metallic member are formed together by molding, the adhesiveness and airtightness of each member is enhanced, thus enabling the provision of a highly reliable head.

14) The substrate and the metallic member are formed together by molding, the mechanical strength of the delicate substrate is enhanced.

15) The two solid layers having different height are formed by a simple method such as a screen printing. Thus, an ink chamber of a large capacity can be formed. By constructing the ink chamber large to retain more ink provisionally, it is possible to stabilize the ink supply in a head having many numbers of discharging ports, thus enabling ink to be discharged stably.

16) The contour of a recording head and the ink supply inlet can be formed by the application of a transfer mold formation method without using any complicated metallic dies, and others. Therefore, it is possible to manufacture the ink jet recording head which has an excellent adhesiveness to the substrate and strength as well as an excellent resistance to heat easily at a lower cost.

What is claimed is:

1. A method for manufacturing an ink jet head having a liquid path, comprising the steps of:

preparing a substrate having a first side and a second side, the second side being a backside of the first side, and having disposed on said first side an ink discharge energy generating element for discharging ink;

joining a support member having a high thermal conductivity, a top side and a bottom side to the second side of said substrate, said second side facing said top side of said support member;

providing a dissolvable solid layer for forming a liquid path pattern corresponding to said liquid path on said first side of said substrate in correspondence with said discharge energy generating element, said substrate, said support member, and said dissolvable solid layer together forming an assembly;

coating a resin for forming a liquid path wall by transfer molding on the assembly, in which the substrate is Joined to a part of the support member, so that both said first side of said substrate and a portion on said bottom side of said support member corresponding to said substrate are coated with said resin, defining a coating area, and a region of said support member projects beyond said coating area; and forming said liquid path by dissolving and removing said dissolvable solid layer.

2. A method according to claim 1, wherein said support member is formed of metal material.

3. A method according to claim 1, wherein a length of said support member is longer than a length of the coated area of said substrate and said resin.

4. An ink jet head having a liquid path, the ink jet head having been manufactured by the steps of:

preparing a substrate having a first side and a second side, the second side being a backside of the first side, and having disposed on said first side an ink discharge energy generating element for discharging ink;

joining a support member having a high thermal conductivity, a top side and a bottom side to the second side of said substrate, said second side facing said top side of said support member;

providing a dissolvable solid layer for forming a liquid path pattern corresponding to said liquid path on said first side of said substrate in correspondence with said discharge energy generating element, said substrate, said support member, and said dissolvable solid layer together forming an assembly;

coating a resin for forming a liquid path wall by transfer molding on the assembly, in which the substrate is joined to a part of the support member, so that both said first side of said substrate and a portion on said bottom side of said support member corresponding to said substrate are coated with said resin, defining a coating area, and a region of said support member projects beyond said coating area; and forming said liquid path by dissolving and removing said dissolvable solid layer.

5. An ink jet head according to claim 4, wherein each of said ink discharging energy generating elements is a resistive body, and heat generated by said resistive body is transmitted to ink to cause the ink to create a film boiling phenomenon, thereby discharging the ink.

6. An ink jet head according to claim 4, wherein said head is a full-line head having a plurality of discharging ports disposed along a length corresponding to an entire width of a recording medium.

7. An ink jet apparatus comprising:

an ink jet head having a liquid path, said ink jet head having been manufactured by the steps of:

preparing a substrate having a first side and a second side, the second side being a backside of the first side, and having disposed on said first side an ink discharge energy generating element for discharging ink;

joining a support member having a high thermal conductivity, a top side and a bottom side to the second side of said substrate, said second side facing said top side of said support member;

providing a dissolvable solid layer for forming a liquid path pattern corresponding to said liquid path on said first side of said substrate in correspondence with said discharge energy generating element, said substrate, said support member, and said dissolvable solid layer together forming an assembly;

coating a resin for forming a liquid path wall by transfer molding on the assembly, in which the substrate is joined to a part of the support member, so that both said first side of said substrate and a portion on said bottom side of said support member corresponding to said substrate are coated with said resin, defining a coating area, and a region of said support member projects beyond said coating area; and forming said liquid path by dissolving and removing said dissolvable solid layer; and a member on which said head is mounted.

* * * * *

UNITED STATES PATENT AND TRADEMARK OFFICE

CERTIFICATE OF CORRECTION

PATENT NO. : 5,774,150

DATED : June 30, 1998

INVENTOR(S) : JUNICHI KOBAYASHI, ET AL.

It is certified that error appears in the above-identified patent and that said Letters Patent is hereby corrected as shown below:

COLUMN 1

Line 14, "Jet" should read --jet--.

COLUMN 3

Line 19, "The" should read --In the--;
Line 30, "cost-up" should read --increase in cost--;
Line 59, "the cost" should read --an increase in cost--; and
Line 60, "up" should be deleted.

COLUMN 4

Line 42, "an" should read --a--.

COLUMN 6

Line 63, "Jet" should read --jet--.

COLUMN 9

Line 35, "The" should read --As for the--.

COLUMN 10

Line 28, "an" should be deleted.

COLUMN 15

Line 66, "The" should read --As the--.

COLUMN 17

Line 17, "assemble;" should read --assembly;--.

UNITED STATES PATENT AND TRADEMARK OFFICE

CERTIFICATE OF CORRECTION

PATENT NO. : 5,774,150

DATED : June 30, 1998

INVENTOR(S) : JUNICHI KOBAYASHI, ET AL.

It is certified that error appears in the above-identified patent and that said Letters Patent is hereby corrected as shown below:

COLUMN 18

Line 38, "dews, wets," should read --dew, moisture,--.

COLUMN 22

Line 3, "dissolve" should read --dissolved--.

COLUMN 23

Line 15, "an" should be deleted; and
Line 32, "cut off," should read --cutoff,--.

COLUMN 24

Line 4, "to be escaped" should read --to escape--;
Line 5, "takeplace" should read --take place--; and
Line 55, "Joined" should read --joined--.

Signed and Sealed this

Twenty-seventh Day of April, 1999

*Attest:*

*Attesting Officer*

Q. TODD DICKINSON

*Acting Commissioner of Patents and Trademarks*